US009120305B2

(12) United States Patent
Marumoto et al.

(10) Patent No.: US 9,120,305 B2
(45) Date of Patent: Sep. 1, 2015

(54) IMAGE RECORDING APPARATUS, IMAGE RECORDING METHOD, AND STORAGE MEDIUM

(71) Applicant: CANON KABUSHIKI KAISHA, Tokyo (JP)

(72) Inventors: Yoshitomo Marumoto, Kawasaki (JP); Hitoshi Tsuboi, Kawasaki (JP); Takayuki Ushiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/509,903

(22) Filed: Oct. 8, 2014

(65) Prior Publication Data

US 2015/0158289 A1 Jun. 11, 2015

(30) Foreign Application Priority Data

Dec. 10, 2013 (JP) ..... 2013-255201

(51) Int. Cl.

| | |
|---|---|
| ***B41J 29/393*** | (2006.01) |
| ***B41J 2/045*** | (2006.01) |
| ***B41J 2/21*** | (2006.01) |

(52) U.S. Cl.
CPC ..... *B41J 2/04501* (2013.01); *B41J 2/21* (2013.01)

(58) Field of Classification Search
CPC .... B41J 2/2132; B41J 29/393; B41J 2/04543; G06K 15/107; G06K 2215/111; H04N 1/1913; H04N 1/4057
USPC ..... 347/14, 15, 43
See application file for complete search history.

(56) References Cited

U.S. PATENT DOCUMENTS 8,608,271 B2 * 12/2013 Murayama et al. ..... 347/15
8,873,103 B2 * 10/2014 Tsuchiya et al. ..... 358/1.9

FOREIGN PATENT DOCUMENTS

JP 01-113249 A 5/1989
JP 2008-229864 A 10/2008

* cited by examiner

*Primary Examiner* — Thinh Nguyen
(74) *Attorney, Agent, or Firm* — Canon USA, Inc. I.P. Division

(57) ABSTRACT

The number of recording-permitted pixels in an increment in each of multiple mask patterns is a relatively small number, and the number of recording-permitted pixels in an increment in each of multiple logical sum patterns is a relatively large number.

24 Claims, 24 Drawing Sheets

IMAGE RECORDING APPARATUS, IMAGE RECORDING METHOD, AND STORAGE MEDIUM

BACKGROUND OF THE INVENTION

1. Field of the Invention

The present invention relates to an image recording apparatus, an image recording method, and a storage medium.

2. Description of the Related Art

There are known recording apparatuses which record images by repeatedly performing scanning to record by discharging ink on a recording medium, by moving a recording head in which multiple discharge orifices which discharge ink are arrayed as to unit regions of the recording medium, and sub-scanning, in which the recording medium is conveyed. This sort of recording apparatus form an image by scanning the unit region multiple times, discharging ink according to a pattern in which multiple recording pixels are laid out, corresponding to positions at which ink is to be discharged in each scan. This is known as multi-pass recording.

Recording apparatuses which record by the above-described method have been conventionally known to apply mask patterns according to various conditions. Japanese Patent Laid-Open No. 2008-229864 discloses an arrangement wherein the number of recording pixels adjacent to each other in a pattern used to perform recording in monochrome mode which readily exhibits uneven density is made to be greater than the number of recording pixels adjacent to each other in a pattern used to perform recording in color mode which readily exhibits deterioration in granularity.

On the other hand, in recent years printed products for various uses have come to be created by inkjet recording, and accordingly various types of inks and recording mediums have come to be used. Japanese Patent Laid-Open No. 1-113249 discloses a method in which an ink including resin emulsion and a water-absorption resistant recording medium. Heat is applied when the ink lands on the recording medium, causing the resin emulsion to form a film, thus fixing the color material included in the ink onto the recording medium.

However, it has been found that recording using the ink and recording medium disclosed in Japanese Patent Laid-Open No. 1-113249 may cause beading, where ink droplets come into contact with each other and attract each other. This may lead to color unevenness in the recorded image. This problem will be described in detail.

FIGS. 1A and 1B are diagrams for describing the process of recording an image by multi-pass recording, using an ink including resin emulsion and a water-absorption resistant recording medium. Description will be made here by way of an example where eight recording scans are performed to complete the image.

FIG. 1A is a schematic diagram illustrating the front surface of an image after having discharged ink by the first scan of a unit region on the recording medium. The black tiles in the grid represent the recording pixels which are the positions where ink is to be discharged to, and the circles indicated by screentone represent the state of ink droplets which have actually been discharged as to the recording pixels. FIG. 1A illustrates a case of having recorded a pattern in which the recording pixels have been dispersed so as to maximally avoid the adjacent ink droplets from coming into contact with each other.

The ink does not permeate the recording medium due to the above-described nature of the ink and recording medium. Accordingly, the ink wets and spreads on the surface of the recording medium until fixed. Even in a case of using a pattern in which the recording pixels have been maximally dispersed such as illustrated in FIG. 1A, the ink droplets may come into contact with each other on the recording medium, which may lead to the above-described beading. In a case where there are regions formed within a unit region which are low in temperature, due to variance in heating and so forth, more time is required to fix the ink, and accordingly the beading becomes more pronounced.

On the other hand, FIG. 1B is a schematic diagram illustrating the front surface of a pattern, arranged such that multiple recording pixels are adjacent, after having discharged ink by the first scan of a unit region on the recording medium. Note that the pattern illustrated in FIG. 1B includes the same number of recording pixels as the recording pixels in the pattern in FIG. 1A.

In a case where ink is discharged using the pattern illustrated in FIG. 1B, four ink droplets corresponding to the mutually adjacent four recording pixels are discharged in close proximity within the unit region, so the four ink droplets group together a form one large ink droplet. Recording using such large ink droplets provides a greater distance between the multiple large ink droplets as compared with the arrangement illustrated in FIG. 1A. Further, the four ink droplets in contact with each other form a large ink droplet by drawing close to each other. Accordingly, dots formed by the large ink droplets being fixed are smaller in diameter as compared to the state illustrated in FIG. 1B immediately after the ink has landed.

From such reasons, recording using a pattern arranged such that multiple recording pixels are adjacent enables ink to be discharged such that multiple large ink droplets are not in contact with each other, despite the number of ink droplets discharged being the same. Accordingly, beading between the multiple large ink droplets can be suppressed, and images can be recorded in which is suppressed marked color unevenness due to beading between ink droplets which have landed far away from each other.

However, it has been found that another problem occurs in images recorded using a pattern wherein multiple recording pixels are adjacent, in a case where there is recording position deviation among different scans. A case where deviation in recording medium conveyance has occurred will be described here as an example of this recording position deviation.

FIG. 2A is a schematic diagram illustrating the front surface of an image after having discharged ink according to the pattern illustrated in FIG. 1A, conveying the recording medium, and then discharging ink using a pattern in which recording pixels are dispersed in a different scan following the conveying. FIG. 2B is a schematic diagram illustrating the front surface of an image after having discharged ink according to the pattern illustrated in FIG. 1B in the first scan, conveying the recording medium, and then discharging ink using a pattern in which recording pixels are laid out adjacently in the second scan following the conveying. FIG. 3A is a schematic diagram illustrating the front surface of an image after having discharged ink according to the pattern illustrated in FIG. 1A, deviation occurs in conveyance of the recording medium, and then discharging ink using a pattern in which recording pixels are dispersed in a different scan following the conveying. FIG. 3B is a schematic diagram illustrating the front surface of an image after having discharged ink according to the pattern illustrated in FIG. 1B in the first scan, deviation occurs in conveyance of the recording medium, and then discharging ink using a pattern in which recording pixels are laid out adjacently in the second scan following the conveying. The hatched circles in FIGS. 2A through 3B represent the ink droplets discharged in the first scan, and the circles indicated by screentone represent the ink droplets discharged in the second scan.

For sake of brevity here, FIGS. 3A and 3B both illustrate a case where the conveyance amount has deviated just one pixel to the upstream side in the Y direction. Accordingly, a comparison of FIGS. 2A and 2B with FIGS. 3A and 3B reveals that ink droplets are discharged at positions deviated one pixel worth to the upstream side in the Y direction as compared to the respective recording pixels in the case of conveyance deviation illustrated in FIGS. 3A and 3B.

In a case of using the pattern where the recording pixels are dispersed, occurrence of conveyance deviation changes the ink droplet coverage area little as compared to the case without conveyance deviation illustrated in FIG. 2A, as can be seen from FIG. 3A.

On the other hand, in a case of using the pattern where the recording pixels are laid out adjacently, occurrence of conveyance deviation markedly reduces the ink droplet coverage area as compared to the case without conveyance deviation illustrated in FIG. 2B, as can be seen from FIG. 3B. Accordingly, multiple regions 100 to which no ink has been discharged (hereinafter also referred to as non-discharge region) are formed extending several pixels worth in the X direction. Such non-discharge regions 100 allow the front surface of the recording medium to show through in the final image, which is visually recognized as white spots. Thus, non-discharge regions 100 are an image quality deteriorating factor.

Also, in a case where the first scan and the second scan are far away from each other (e.g., in a case of an apparatus which records with eight scans, where the first scan is scan No. 1 and the second scan is scan No. 5), the greater the chance is that the above-described conveyance deviation will occur, so white spots occur more readily.

While description has been made here regarding a case where non-discharge regions occur at the time of conveyance deviation of the recording medium, non-discharge regions occur due to various types of recording position deviation when using the pattern where multiple recording pixels are laid out adjacently, as described above. For example, the above-described non-discharge regions occur more readily when using a so-called joint head, where multiple discharge orifice rows of multiple discharge orifice rows corresponding to the same color ink arrayed in the Y direction, are arrayed in the Y direction.

FIGS. 4A and 4B are diagrams for describing the mechanism of non-discharge regions being formed in a case of using a joint head. FIG. 4A is a diagram illustrating a joint head configured with multiple discharge orifice rows having been disposed without error. Consideration will now be made regarding a case of performing recording by two scans of a unit region on the recording medium, to record by multi-path recording using such a joint head 123*a*. In this case, at the first scan ink is discharged from a discharge orifice row 122*a*, the unit region is conveyed from position 123 to position 124, and at the second scan ink is discharged from discharge orifice row 122*b*, thereby recording the image.

However, there are cases where the discharge orifice row 122*b* is disposed rotated from the proper position illustrated in FIG. 4A, due to manufacturing error at the time of manufacturing the joint head, as illustrated in FIG. 4B. Performing recording by the above-described multi-pass method using such a joint head 123*b* results in the discharge positions of ink deviating on both the X direction and Y direction when discharging ink from the discharge orifice row 122*b*. Accordingly, ink is not discharged to the portion of the recording medium corresponding to a region 126 of the joint head 123*b* illustrated in FIG. 4B, resulting in the above-described non-discharge region of ink.

SUMMARY OF THE INVENTION

It has been found desirable to provide an image recording apparatus, an image recording method, and a storage medium, which can suppress both color unevenness due to beading, and occurrence of non-discharge regions due to deviation in conveyance, placement of discharge orifice rows, and so forth.

An image recording apparatus which records images includes a recording head, a scanning unit, a conveying unit, a generating unit, and a recording control unit. The recording head is configured including at least one discharge orifice row in which a plurality of discharge orifices for discharging ink of a predetermined color are arrayed in an array direction. The scanning unit is configured to cause the recording head and a unit region on a recording medium to be scanned a plurality of times in a scanning direction which intersects the array direction. The conveying unit is configured to convey the recording medium a distance corresponding to a length in the array direction of each of a plurality of discharge orifice groups of a predetermined number of discharge orifices continuously arrayed in the array direction, configured as divisions of the plurality of discharge orifices in a conveying direction which intersects the scanning direction, the conveying being performed in between the plurality of scans of the recording head. The generating unit configured to generate recording data so as to discharge ink to the unit region from the plurality of discharge orifice groups, in each of the plurality of scans of image data corresponding to the unit region performed as to the unit region, based on a plurality of mask patterns corresponding to each of the plurality of discharge orifice groups, in each of which mask patterns recording-permitted pixels determining permission of recording to the unit region and recording-not-permitted pixel determining non-permission of recording thereto have been laid out. The recording control unit is configured to discharge ink from each of the plurality of discharge orifice groups to the unit region in each of the plurality of scans, based on the recording data. With regard to a first mask pattern group made up of at least two mask patterns out of the plurality of mask patterns, each mask pattern in the first mask pattern group includes a plurality of first pixel regions where a plurality of the recording-permitted pixels and a plurality of the recording-not-permitted pixels have been laid out, and a plurality of second pixel regions where only a plurality of recording-not-permitted pixels have been laid out. The plurality of first pixel regions in each of the mask patterns in the first mask pattern group are configured at mutually corresponding positions. An average number of the recording-permitted pixels in an increment in each mask pattern of the first mask pattern groups is a predetermined value or less, both a recording-permitted pixel group configured including a plurality of the recording-permitted pixels adjacent to each other in the array direction or the scanning direction and a recording-permitted pixel not adjacent to other recording-permitted pixels being counted as an increment. An average number of the recording-permitted pixels in the increments in a first logical sum pattern, obtained as a logical sum of the plurality of the recording-permitted pixels laid out in each of the mask patterns within the first mask pattern group, is greater than the predetermined value.

Further features of the present invention will become apparent from the following description of exemplary embodiments with reference to the attached drawings.

DESCRIPTION OF THE EMBODIMENTS

First Embodiment

Figure 1A:
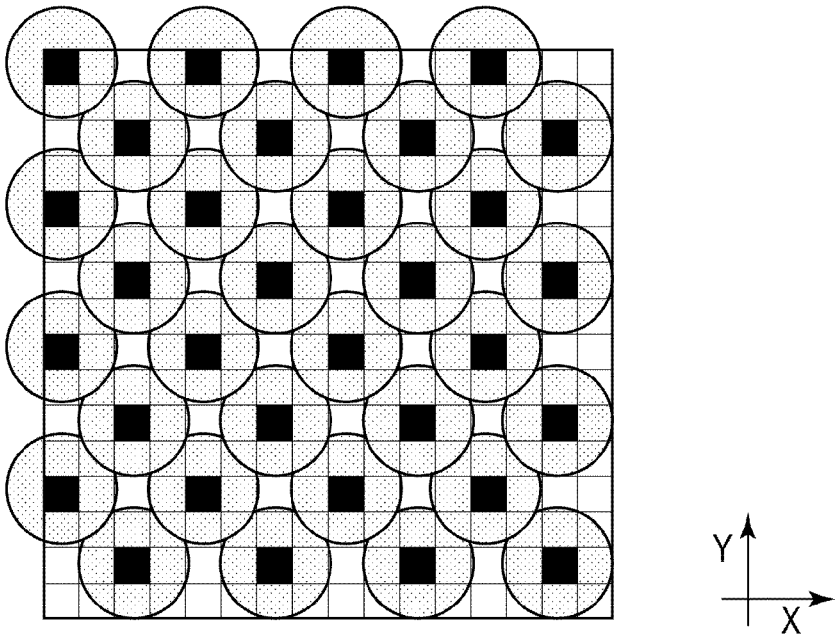
FIGS. 1A and 1B are diagrams for describing beading.
Figure 1B:
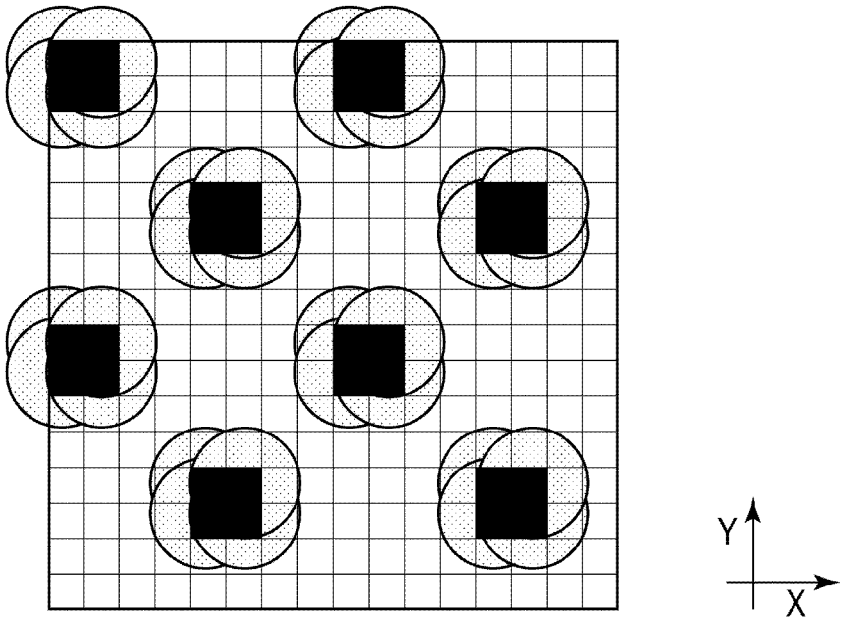
Figure 2A:
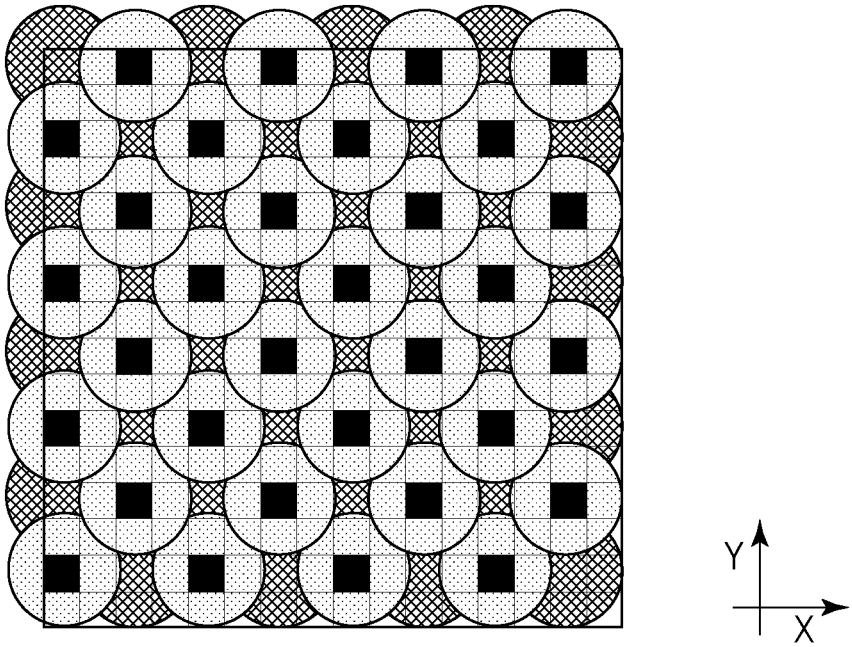
FIGS. 2A and 2B are diagrams for describing multi-pass recording without occurrence of non-discharge regions which occur due to conveyance deviation of a recording medium.
Figure 2B:
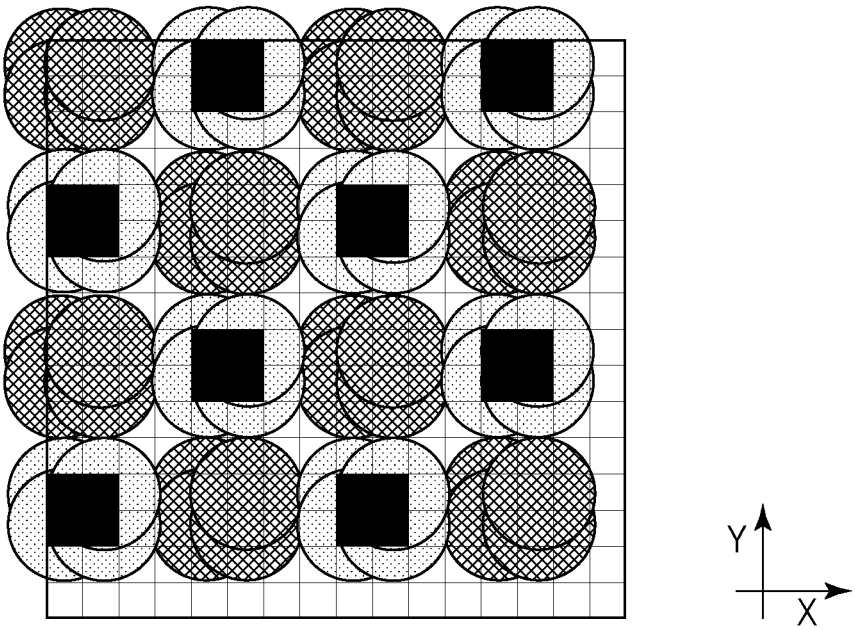
Figure 3A:
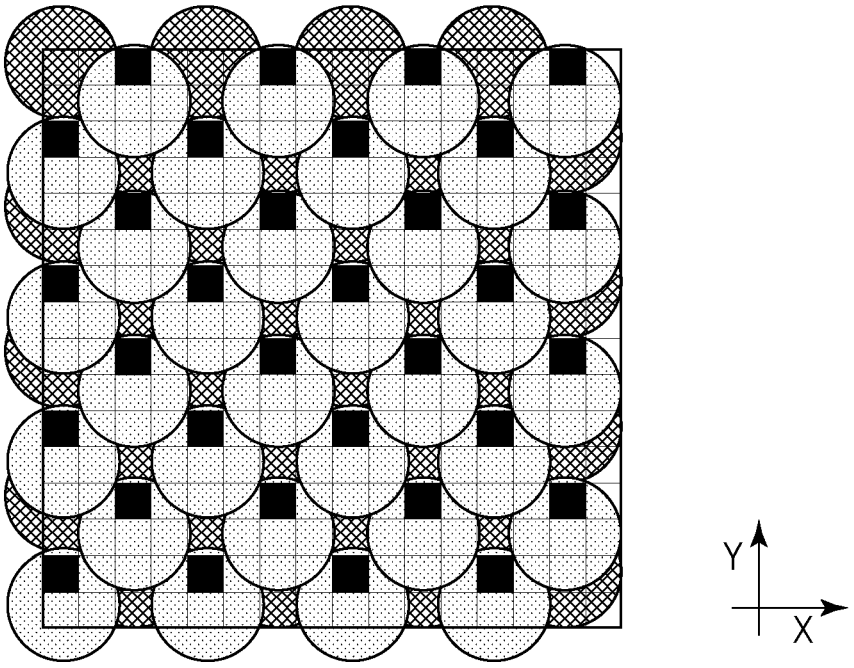
FIGS. 3A and 3B are diagrams for describing multi-pass recording with occurrence of non-discharge regions which occur due to conveyance deviation of a recording medium.
Figure 3B:
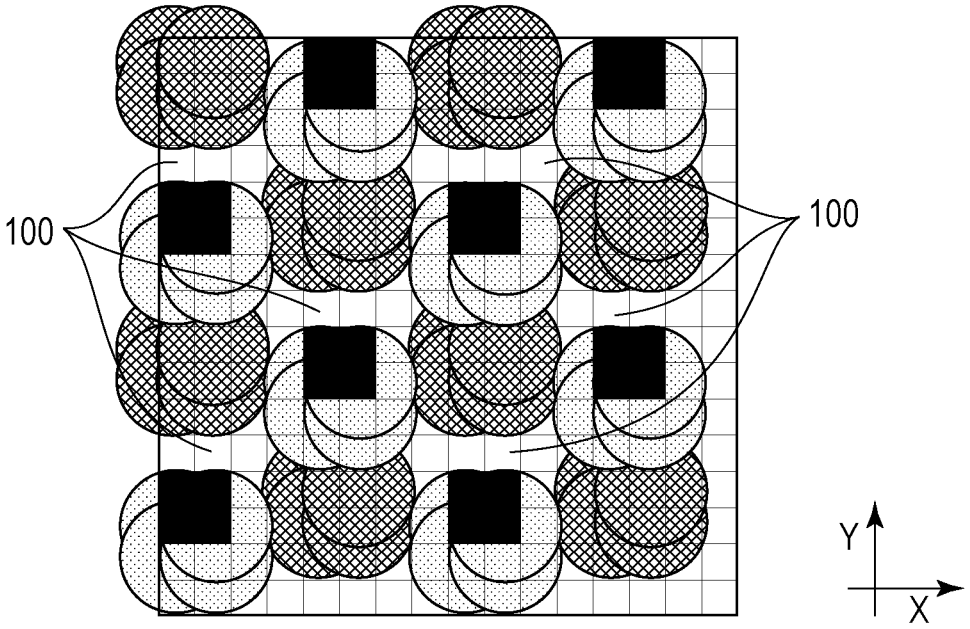
Figure 4A:
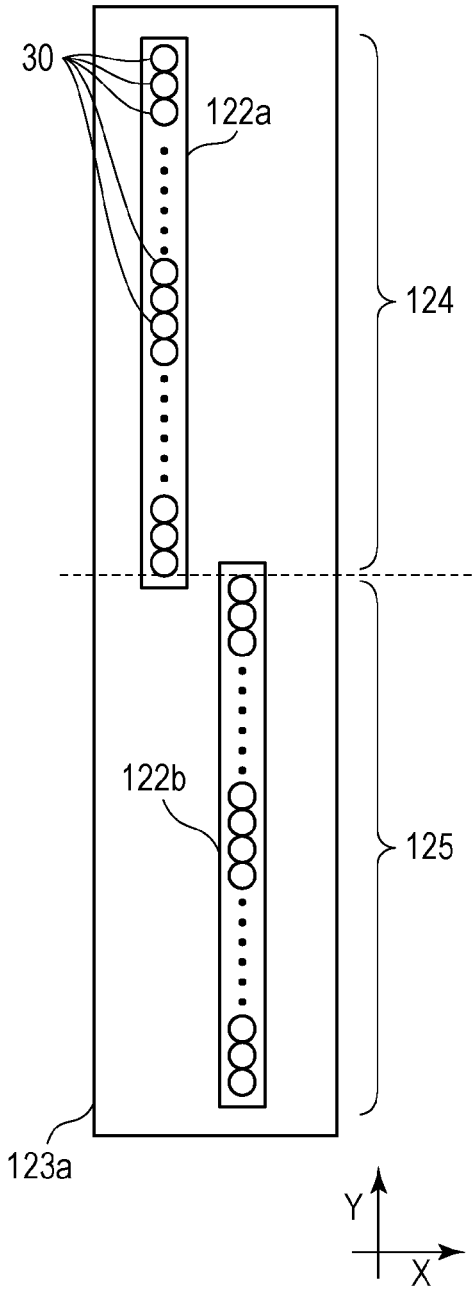
FIGS. 4A and 4B are diagrams for describing occurrence of non-discharge regions which occur due to placement deviation of a discharge orifice row.
Figure 4B:
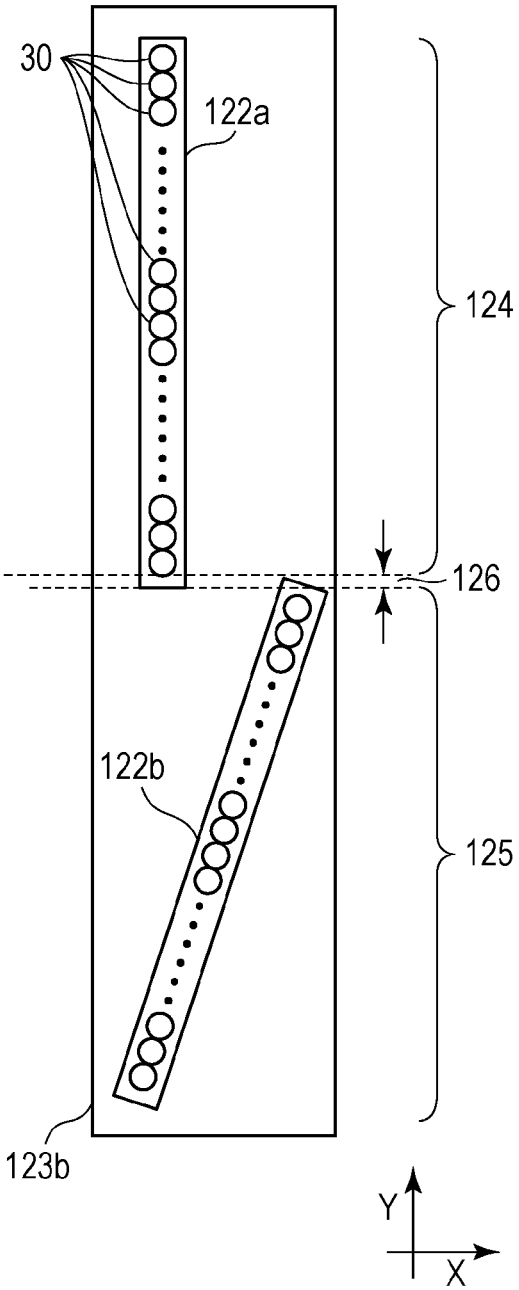
Figure 5:
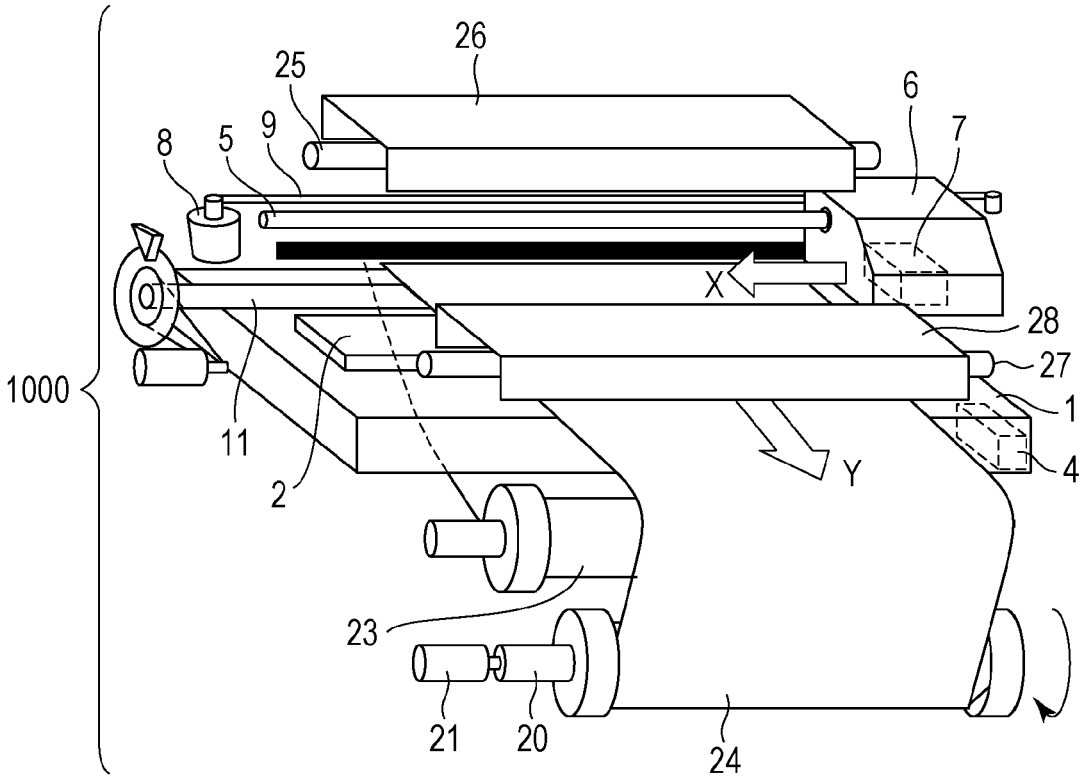
FIG. 5 is a perspective view of an image recording apparatus to which a first embodiment is applied.
Figure 6:
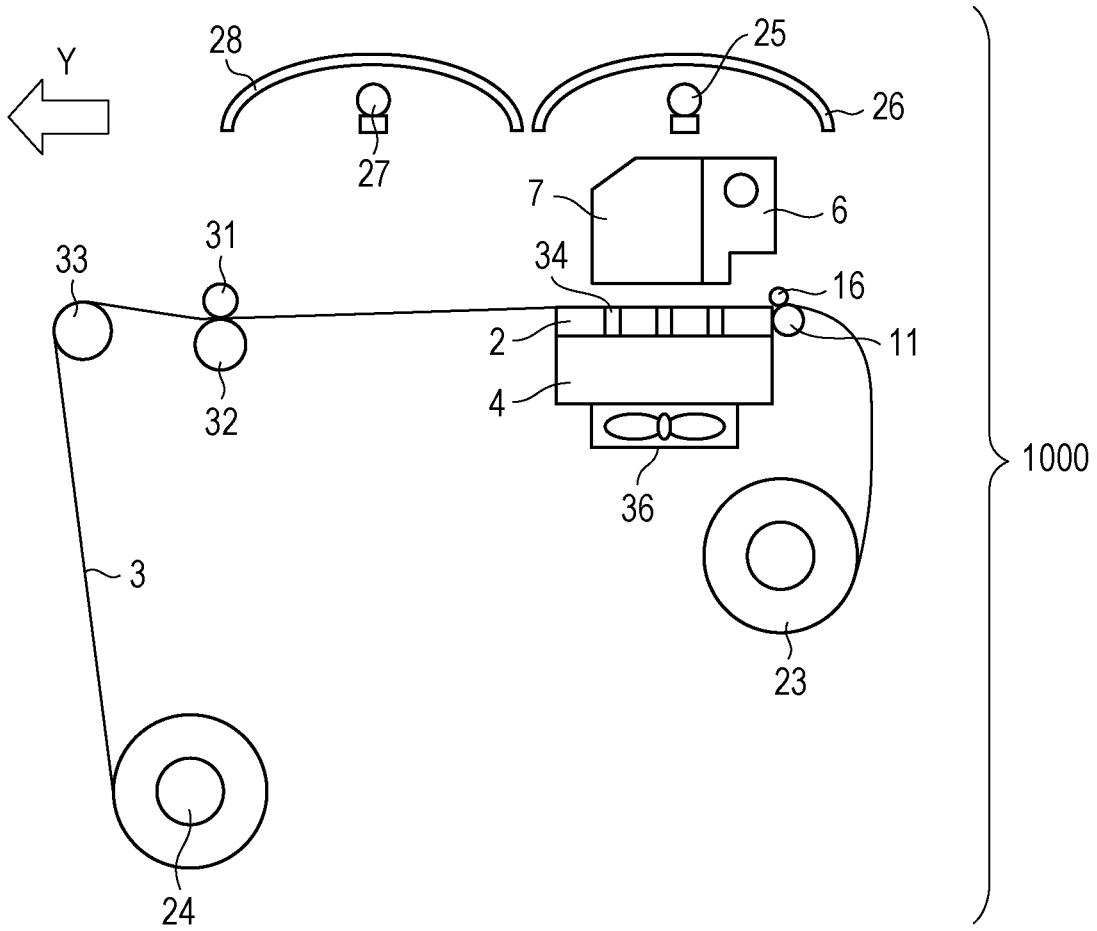
FIG. 6 is a side view of an internal mechanism of the image recording apparatus to which the first embodiment is applied.

A first embodiment will be described. FIG. 5 is a perspective view partially illustrating the configuration of an image recording apparatus according to the present embodiment. FIG. 6 is a side view partially illustrating the configuration of the image recording apparatus according to the present embodiment.

A housing 1 is provided within the image recording apparatus 1000. A platen 2 is disposed upon this housing 1. Also provided within the housing 1 is a suctioning device 4 to suction a recording medium 3, which has the form of a sheet, to the platen 2. A main rail 5 is disposed in the longitudinal direction of the housing 1, so as to support a carriage 6 which reciprocally moves in the X direction (scanning direction). Mounted on the carriage 6 is an ink-jet type recording head 7. The recording head 7 may be any of a variety of ink-jet types, such as those using heating elements, those using piezoelectric elements, and so forth. A carriage motor 8 serves as a driving source to movement carriage 6 in the X direction, the rotational driving force thereof being transmitted to the carriage 6 by a belt 9. The position of the carriage 6 in the X direction is monitored by detection using a linear encoder. The linear encoder is configured including a linear encoder pattern (omitted from illustration in FIG. 5) attached to the housing 1 and a reading unit (omitted from illustration in FIG. 5) mounted to the carriage 6, which optically, magnetically, or mechanically reads the linear encoder pattern 10.

The recording medium 3 is fed from a roll-shaped sheet feed medium 23 provided to a sheet feed spool. Although various types of media are conceivable for use as the recording medium 3, a non-water absorbing or low-water absorbing medium is preferably used, taking into consideration outdoor display of the recorded product. Examples include those of which the recording surface is formed of a low-water absorbing resin such as a vinyl chloride sheet or the like. The sheet feed spool 18 has a torque limiter which acts to provide a braking force to the recording medium 3. The recording medium 3 is conveyed over the platen 2 in the Y direction (conveyance direction) which intersects the X direction of the carriage 6. This conveyance is carried out by a driving mechanism which includes a conveyance roller 11, a belt 12, a pinch roller 16, and a conveyance motor. The driving state of the conveyance roller 11 (rotational amount and rotational speed) is detected and monitored by a rotary encoder. The rotary encoder includes an encoder pattern, which is cylindrical in shape and rotates along with the conveyance roller 11, and a reading unit which optically, magnetically, or mechanically reads the encoder pattern. After being recorded upon by the recording head 7, the recording medium 3 is spooled by a take-up spool 20, thus forming a roll-shaped spooled medium 24. The take-up spool 20 is rotated by a take-up motor 21, and includes a torque limiter which acts to provide wind-up tension to the recording medium 3.

The present embodiment is configured including a first heater 25 situated at a position facing the platen 2, and a second heater 27 situated on the downstream side in the Y direction from the platen 2 and facing the platen 2, the heat of which is used to fix the color material included in the ink onto the recording medium 3.

The first heater 25 is covered by a first heater cover 26, and the second heater 27 by a second heater cover 28. The first heater cover 26 and second heater cover 28 each function to efficiently irradiate the front surface of the recording medium 3 by the heat from the heaters 25 and 27, and also to protect the respective heaters 25 and 27. The first heater 25 is provided to evaporate moisture contained in the ink, so that the viscosity of the ink increases. At the time of the recording head 7 discharging ink, the recording medium 3 is uniformly heated. The temperature of the first heater 25 is set such in the present embodiment that the front surface of the recording medium 3 is 60° C. Note that at the point of the heating by the first heater 25, the ink does not have to be completely fixed to the recording medium 3; it is sufficient that the viscosity rises a certain level so that fluidity of the ink on the recording medium 3 drops. Although various methods may be used as the heating method of the first heater 25, such as a fan heater, infrared heater, thermal conduction type heater which comes into direct contact with the recording medium 3, an infrared heater is particularly preferable.

The second heater 27 heats at a higher temperature than the first heater 25, so as to cause the later-described resin emulsion contained in the ink to form a film, thereby fixing the ink droplets onto the recording medium 3. The temperature of the second heater 27 is set such in the present embodiment that the front surface of the recording medium 3 is 90° C.

While description has been made of the present embodiment where heating is performed in two stages, using the first heater 25 and the second heater 27, the present invention is not restricted to this arrangement. For example, heating may be performed in three or more stages, or in one stage alone.

Figure 7:
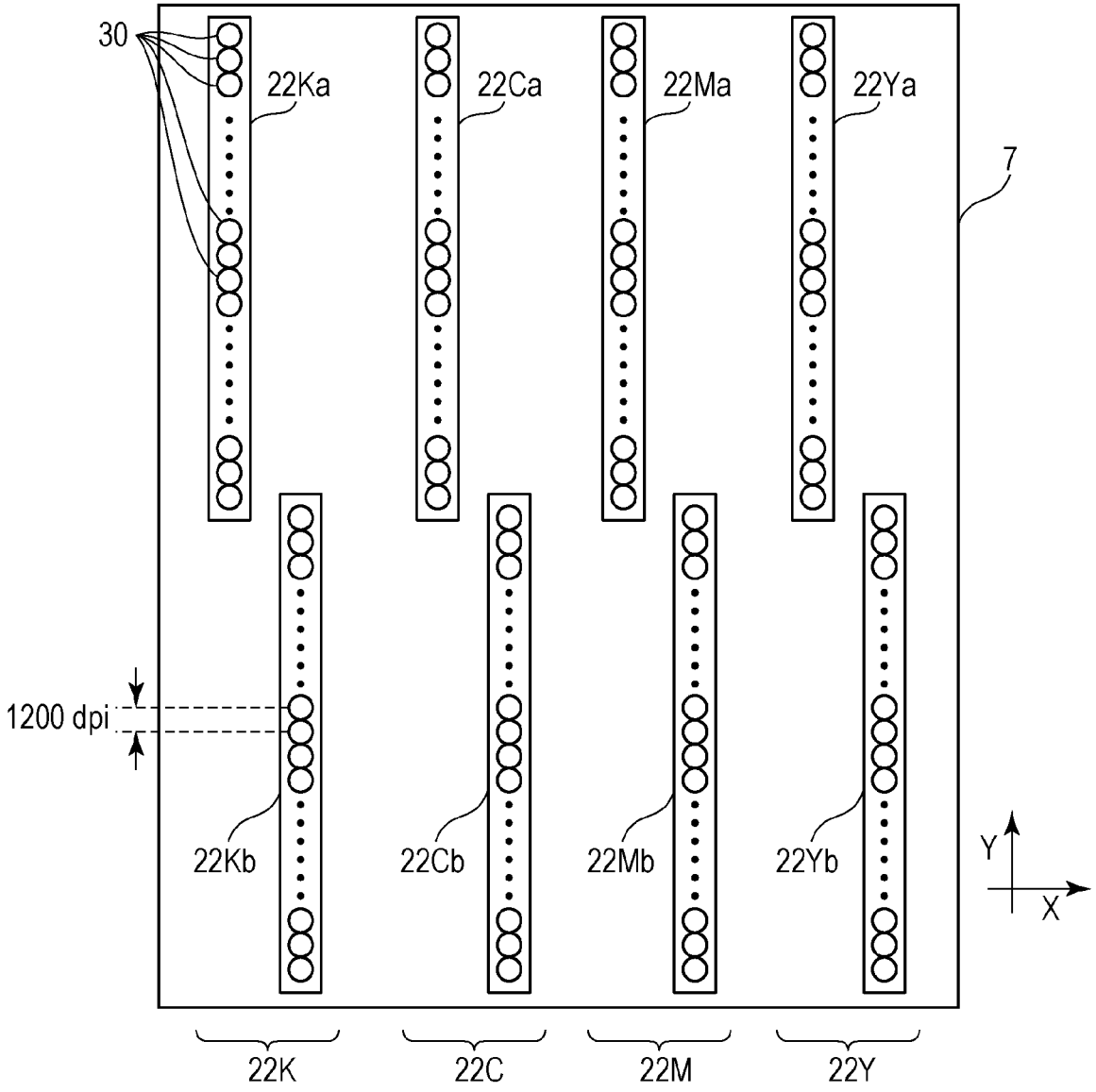
FIG. 7 is a schematic diagram of a recording head to which the first embodiment is applied.

FIG. 7 is a plan view schematically illustrating an array of discharge orifices 30 in a recording head 7 used in the present embodiment. The recording head 7 is configured including four discharge orifice rows 22K, 22C, 22M, and 22Y, which discharge ink of the colors black (K), cyan (C), magenta (M), and yellow (Y), respectively, arrayed in the X direction. The discharge orifice row 22K is configured including rows 22Ka and 22Kb arrayed in the Y direction. The rows 22Ka and 22Kb each have 640 (a predetermined number) of discharge orifices 30 arrayed in the Y direction (array direction) at a density of 1200 dpi. In the same way, each of the discharge orifice rows 22C, 22M, and 22Y also have two rows arrayed in the Y direction, as with the discharge orifice row 22K. The discharge amount of ink discharge at one time from one discharge orifice 30 in the present embodiment is approximately 4.5 ng.

The discharge orifice rows 22K, 22C, 22M, and 22Y are connected to unshown ink tanks which accommodate the corresponding ink, from which ink is supplied. Note that the ink tanks may be formed integrally with the recording head 7 used in the present embodiment, or may each be separable.

All of the inks used in the present embodiment include resin emulsion. In the present embodiment, the term "resin emulsion" means polymer particles existing in the state being suspended in water. Specific examples include combined acrylic emulsions obtained by emulsion polymerization or the like of monomers such as alkyl ester(meth)acrylate or alkylamide(meth)acrylate or the like; combined styrene acrylic emulsions obtained by emulsion polymerization or the like of monomers such as of alkyl ester(meth)acrylate or alkylamide(meth)acrylate or the like; polyethylene emulsions, polypropylene emulsions, polyurethane emulsions, styrene-butadiene emulsions, and so forth. Further, core-shell type resin emulsions in which a core unit and a shell unit making up the resin emulsion have different polymer compositions, or emulsions obtained by using acrylic particles which have been preliminarily combined to control the particle diameter being used as seed particles and emulsion polymerization performed in the perimeter thereof, may be used. Moreover, hybrid resin emulsions obtained by chemically bonding different resin emulsions, such as acrylic resin emulsion and urethane emulsion, or the like, may be used.

Examples of monomers making up the resin emulsion include (meth)acrylate; alkyl ester(meth)acrylate which can be obtained by combining alkyl alcohols such as methyl (meth)acrylate, n-butyl(meth)acrylate, and 2-ethylhexyl (meth)acrylate, with (meth)alkylate; alkylamide(meth)acrylates such as (meth)acrylamide, dimethyl(meth)acrylamide, N,N-dimethyl ethyl(meth)acrylamide, N,N-dimethyl propyl (meth)acrylamide, isopropyl(meth)acrylamide, and diethyl (meth)acrylamide(meth)acryloyl morpholine.

The molecular weight of the resin emulsion used in the ink of the present embodiment is preferably has a number-average molecular weight (Mn) converted into terms of polystyrene, obtained by gel permeation chromatography (GPC), in the range of 100,000 to 3,000,000, and more preferably in the range of 300,000 to 2,000,000.

The average particle diameter of the resin emulsion used in the ink of the present embodiment is preferably in the range of 50 nm to 250 nm.

The glass transition temperature (Tg) of the resin emulsion used in the ink of the present embodiment is preferably in the range of 40° C. to 90° C. From this point of view, it is preferable to use a resin emulsion of methyl(meth)acrylate, n-butyl(meth)acrylate, and 2-ethylhexyl(meth)acrylate, with the Tg of the obtained resin emulsion in the range of 40° C. to 90° C.

The content of the resin emulsion used in the ink according to the present embodiment (% by mass) is preferably 0.1% by mass or more but 10.0% by mass or less, as to the total mass of ink.

The present embodiment uses a sheet formed by a vinyl chloride layer having been formed on a substrate, as the recording medium, but the recording medium according to the present embodiment is not restricted to a vinyl chloride sheet. Although the recording medium 3 of the present exemplary embodiment is not limited to a polyvinyl chloride sheet, the advantages of the present invention becomes notable when a recording medium that has low ink absorbing property or that does not absorb ink is used.

In the present embodiment, an image is recorded by the so-called multi-pass recording method where the recording head is scanned over a unit region of the recording medium multiple times to perform recording.

Figure 8:
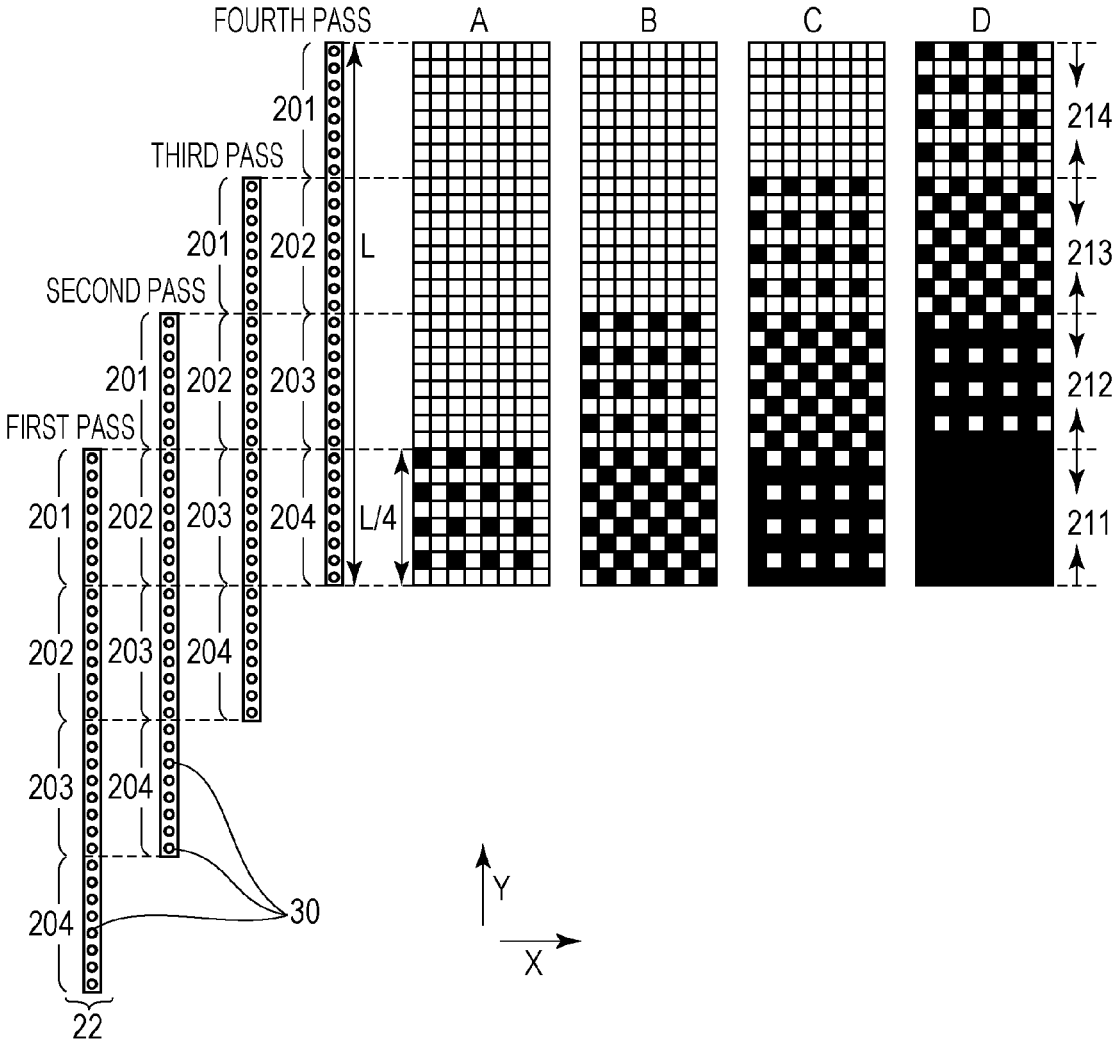
FIG. 8 is a diagram for describing a general multi-pass recording method.
Figure 9A:
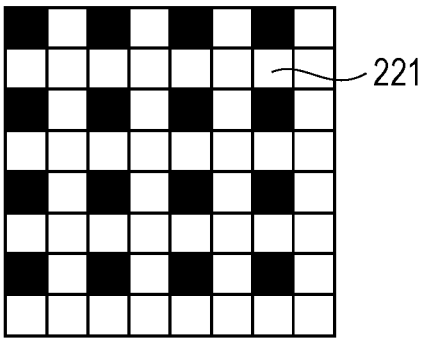
FIGS. 9A through 9D are schematic diagrams illustrating mask patterns to be applied in a general multi-pass recording method.
Figure 9B:
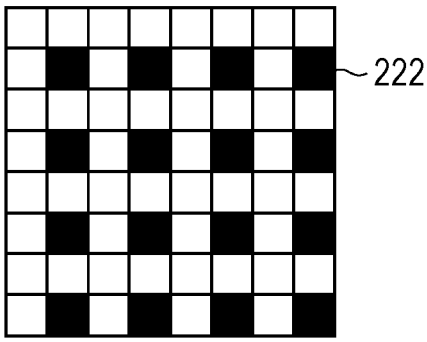
Figure 9C:
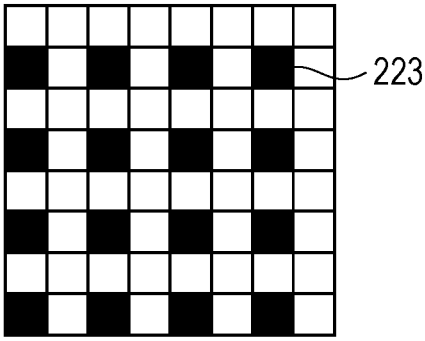
Figure 9D:
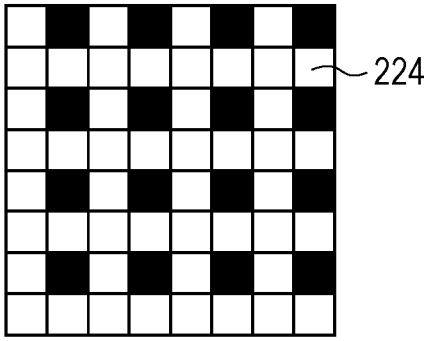

FIG. 8 is a diagram for describing a general multi-pass recording method when recording within a unit region of a recording medium, by performing four recording scans.

FIGS. 9A through 9D are diagrams for describing mask patterns applied at each of the recording scans in the multi-pass recording method. The discharge orifices 30 provided to a discharge orifice row 22 are classified into four discharge orifice groups 201, 202, 203, and 204, in the sub-scanning direction.

Mask patterns 221, 222, 223, and 224 each have a layout of multiple recording-permitted pixels which permit discharge of ink, and recording-not-permitted pixels which forbid discharge of ink. In FIGS. 9A through 9D, the solid black portions represent the recording-permitted pixels, and the white portions represent recording-not-permitted pixels. Image data input to recording-permitted pixels is taken as recording data to discharge ink, in a case where the image data is to discharge ink. On the other hand, image data input to recording-not-permitted pixels is taken as recording data to not discharge ink, even if the image data is to discharge ink.

The recording-permitted pixels are at different positions for each of the mask patterns 221, 222, 223, and 22. And the recording-permitted pixels are laid out so that the OR (logical sum) of all is true at each pixel position. In other words, recording-permitted pixels in a logical sum pattern obtained as a logical sum of the recording-permitted pixels in the mask patterns 221, 222, 223, 224 are corresponding to all of the pixels in the logical sum pattern.

An example of forming an image of which the duty is 100% (hereinafter also referred to as "solid image") on the recording medium will be described. At the first recording scan (first pass), ink is discharged from discharge orifice group 201 as to region 211 on the recording medium 3, according to mask pattern 221. As a result, ink is discharged to positions shown black in A FIG. 8. The recording medium 3 is then conveyed relative to the recording head 7 from the upstream side to the downstream side in the Y direction, by an amount equivalent to L/4.

Subsequently, the second recording scan (second pass) is performed. At the second recording scan, ink is discharged from discharge orifice group 202 as to region 211 on the recording medium 3, according to mask pattern 222, and from discharge orifice group 201 as to region 212 according to mask pattern 221. As a result, an image is formed on the recording medium 3 such as indicated by the black in B FIG. 8.

Thereafter, recording scanning by the recording head 7 and relative conveyance of the recording medium 3 are alternately repeated. As a result, after the fourth recording scan (fourth pass) has been performed, discharge of ink a small section equivalent to all pixels in the region 211 of the recording medium 3 as illustrated in D in FIG. 8, thus forming a solid image. Note that in the following description, a region on the recording medium 3 equivalent to a pixel may be referred to simply as "pixel".

Figure 10:
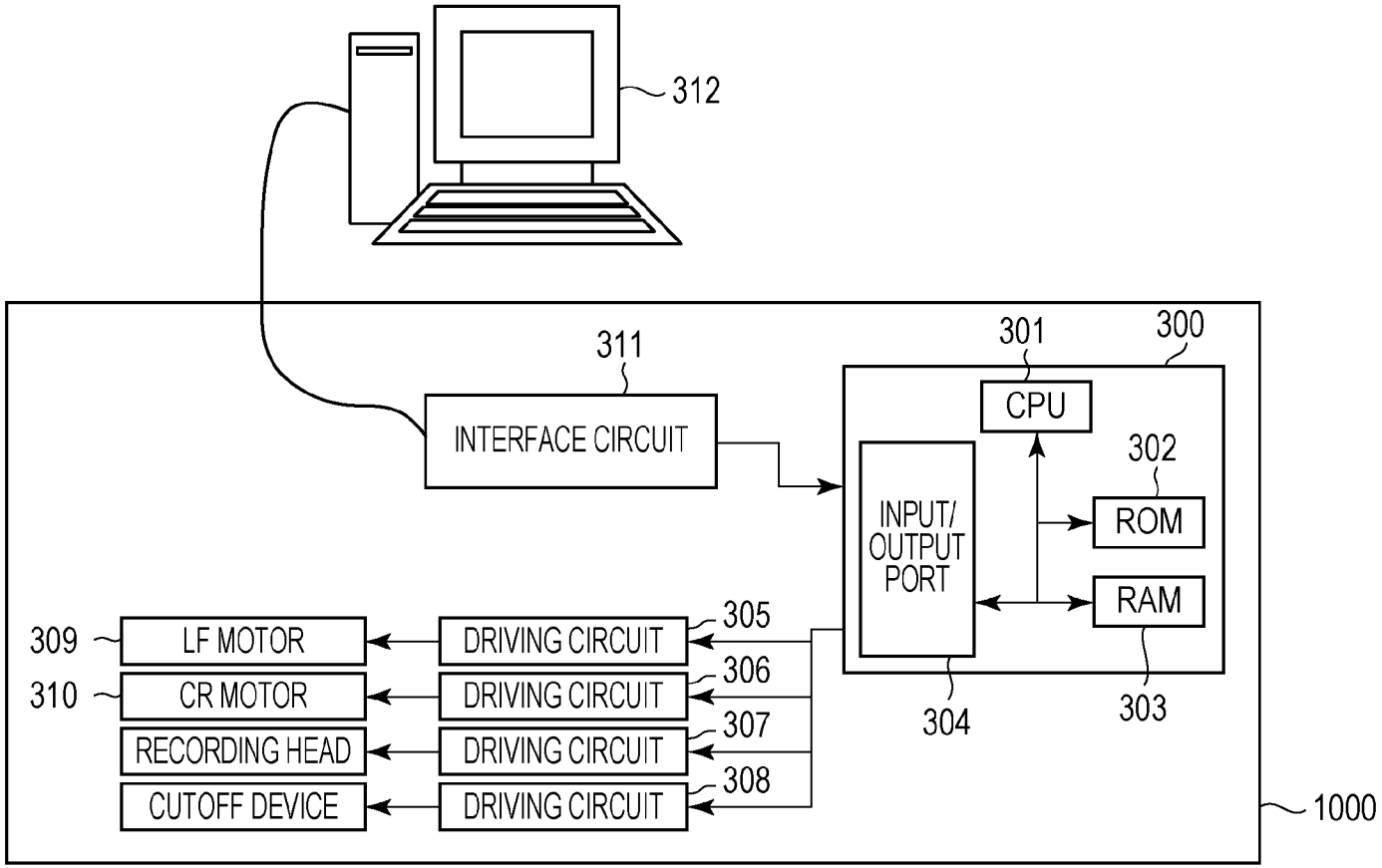
FIG. 10 is a schematic diagram for describing a recording control system according to the first embodiment.

FIG. 10 is a block diagram illustrating a schematic configuration of the control system according to the present embodiment. A main control unit 300 includes a central processing unit (CPU) 301 which performs calculation, selection, determination, control, and other such processing operations, and read-only memory (ROM) 302 which stores control programs to be executed by the CPU 301 and so forth. The main control unit 300 also includes random access memory (RAM) 303 used as a recording data buffer and so forth, and an input/output port 304 and so forth. The ROM 303 also stores later-described mask patterns and so forth. Connected to the input/output port 304 are a conveyance motor (line feed (LF) motor) 309, carriage motor (CR motor) 310, and various driving circuits 305, 306, 307, and 308, which are connected to actuators in the recording head 7 and a cutoff unit and so forth. The main control unit 300 is further connected to a personal computer (PC) 312 serving as a host computer, via an interface circuit 311.

Figure 11:
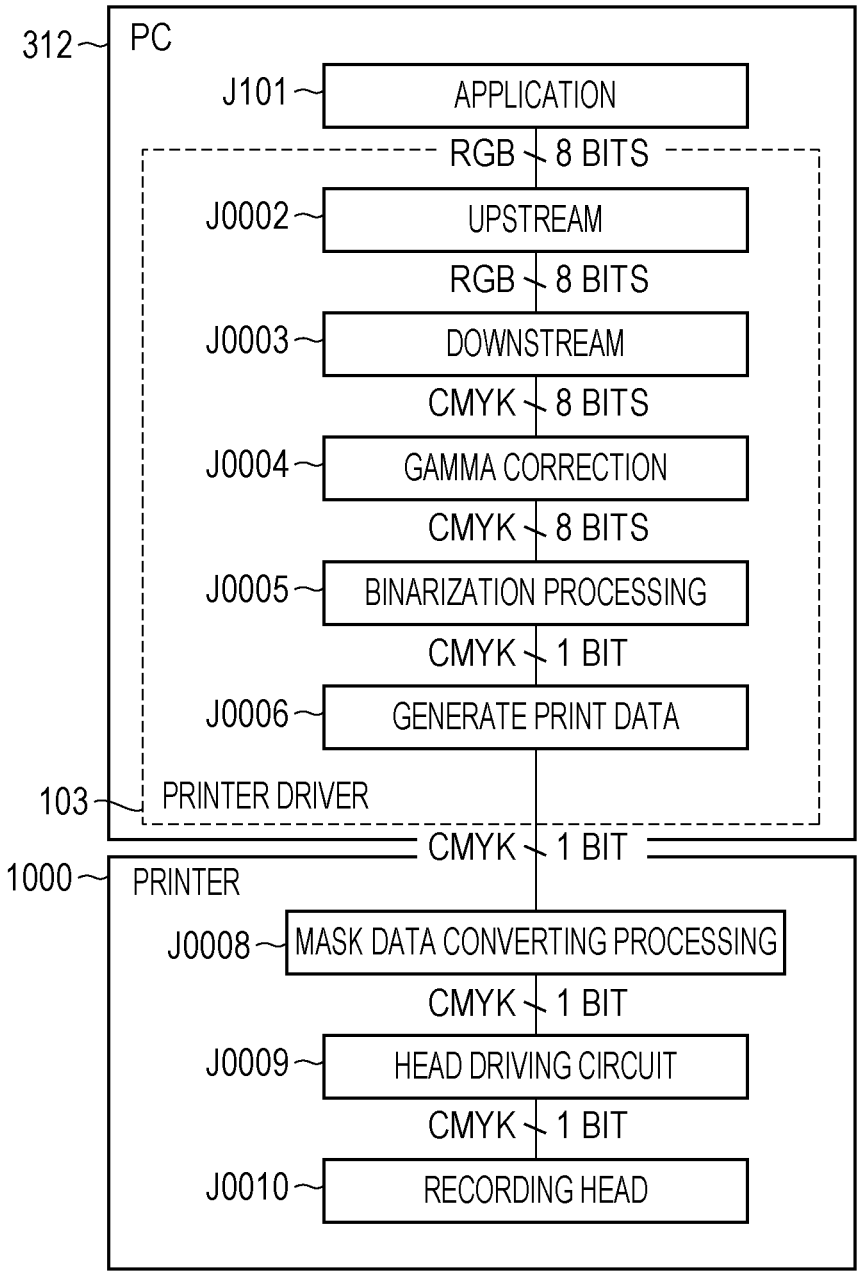
FIG. 11 is a schematic diagram for describing a data processing process according to the first embodiment.

FIG. 11 is a flowchart illustrating image data processing processes according to the present embodiment. A user can create data of an image to record at the recording apparatus 1000, using an application J101 in the PC 312 serving as a host computer. At the time of performing recording, data of an image created at the application J101 is transmitted to a printer driver 103. The printer driver 103 performs upstream processing J0002, downstream processing J0003, gamma correction J0004, binarization processing J0005, and print data generation J0006, on the data of the created image. At the upstream processing J0002 gamut conversion is performed to convert the color gamut if the display of the host computer 312 to the gamut of the printer 1000. A three-dimensional look-up table is used to convert RGB data of the image where each of R, G, and B are represented by 8 bits, into 8-bit data of R, G, and B data in the color gamut of the printer 1000. At the downstream processing J0003, colors reproducing the converted color gamut are separated into the color gamuts of the inks. More specifically, processing is performed to obtain 8-bit data of C, M, Y, and K corresponding to the combination of ink which reproduces the colors which the 8-bit data of R, G, and B in the print color gamut obtained in the upstream processing J0002 represents. At the gamma correction J0004, each of the 8-bit data of C, M, Y, and K obtained by color separation is subjected to gamma correction. Conversion is performed such that each of the 8-bit data of C, M, Y, and K obtained in the downstream processing J0003 is linearly correlated with gradation characteristics of the printer 1000. At the binarization processing J0005, each of the 8-bit data of C, M, Y, and K obtained in the gamma correction J0004 is subjected to quantization processing for conversion into 1-bit data of C, M, Y, and K. Suitably used quantization methods include density pattern, dithering, error diffusion, and other such methods. At the print data generation processing J0006, print control data and so forth is added to the data of the image made up of the 1-bit data of C, M, Y, and K obtained at the binarization processing J0005, and 1-bit printing data is generated. Print control data is made up of information relating to the recording medium, information relating to recording quality, and so forth.

The print data generated in this way is supplied to the printer 1000. At mask data converting process J0008, the print data generated at the print data generation processing J0006, and data of later-described mask patterns set based on position information of the platen 2 corresponding to this print data stored in the ROM 303, are used to convert the print data into recording data, which represents whether or not to form dots, i.e., recording and non-recording of ink at the recording head. A mask pattern is made up of recording-permitted pixels and recording-not-permitted pixels being arrayed in a certain pattern. At recording-permitted pixels, the print data is converted into data representing permission of discharge of ink, and at recording-not-permitted pixels, the print data is converted into data representing non-permission of discharge of ink. Note that the mask patters used in the mask data converting process J0008 is stored in predetermined memory of the printer 1000 beforehand. For example, mask patterns may be stored in the aforementioned ROM 302, and these mask patterns be used to convert into recording data at the CPU 301.

The recording data obtained in the mask data converting process is supplied to the driving circuit 307 which drives the recording head 7, and to the recording head 7. Ink is discharged as to the recording medium 3 from the discharge orifices 30 arrayed on the recording head 7. Recording operations are thus performed by driving of various motors and the recording head 7 being controlled via the input/output port 304, based on the recording data generated by the above-described processes.

Figure 12:
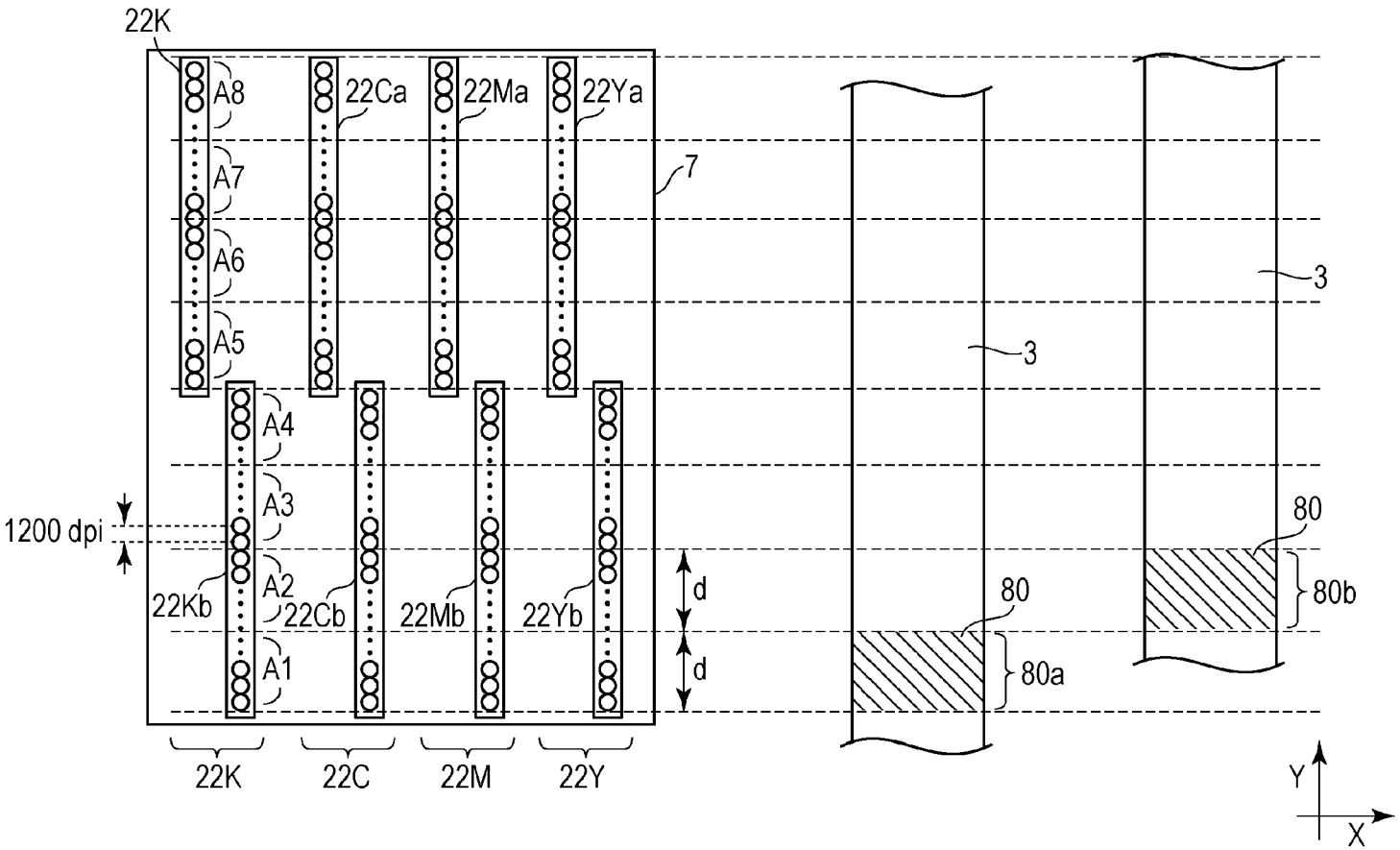
FIG. 12 is a schematic diagram for describing a multi-pass recording method according to the first embodiment.

The multi-pass recording method carried out in the present embodiment will be described in detail below. To simplify description, out of the four discharge orifice rows 22K, 22C, 22M, and 22Y, description will be made only regarding the discharge orifice row 22K which discharges black ink. FIG. 12 is a diagram illustrating the multi-pass recording method according to the present embodiment.

The present embodiment uses a method where an image is completed on a unit region 80 on the recording medium 3 by performing eight recording scans. In the recording head 7 used in the present embodiment, the discharge orifices 30 arrayed in the discharge orifice row 22K which discharges black ink is divided into eight discharge orifice groups, discharge orifice group A1 through discharge orifice group A8, each having a length d. Further, discharge orifice group A1 through discharge orifice group A4 belong to a row 22Kb, and discharge orifice group A5 through A8 belong to a row 22Ka. The number of discharge orifices 30 included in one discharge orifice group is 160.

The length of the unit region 80 on the recording medium 3 in the Y direction is equivalent to the amount of relative movement in the Y direction between the recording head 7 and the recording medium 3 for one movement, and this is also equivalent to the length d of one discharge orifice group in the divided discharge orifice row 22K. The length of the unit region 80 in the X direction is equivalent to the length of the recording medium 3 in the X direction.

First, with the unit region 80 of the recording medium 3 at a position 80*a*, the recording head 7 scans in the X direction. During this scan, the discharge orifices 30 belonging to the discharge orifice group A1 of the discharge orifice row 22K each discharge ink to the unit region 80 following the later-described mask pattern. Subsequently, the recording medium 3 is conveyed in the Y direction by a distance corresponding to the distance d, whereby the unit region 80 is moved to a position 80*b*. Following this conveyance, the recording head 7 scans the unit region 80 on the recording medium 3 in the X direction to which ink has been discharged earlier from the discharge orifices 30 belonging to the discharge orifice group A1, and the discharge orifices 30 belonging to the discharge orifice group A2 of the discharge orifice row 22K each discharge ink to the unit region 80. The recording head 7 is thus scanned a total of eight times over the unit region 80 on the recording medium 3 while conveying the recording medium 3 by the distance corresponding to the distance d between each scan, thus completing the image.

A recording-permitted pixel group is made up of multiple recording-permitted pixels adjacent and continuous in the X direction or Y direction in each of the multiple mask patterns applied in the multiple scans described above. There are also recording-permitted pixels which are isolated and non-contiguous with other recording-permitted pixels. Both recording-permitted pixel groups and isolated recording-permitted pixels are taken as increments of recording-permitted pixels in the present embodiment (hereinafter, also referred to simply as "increment"). The average number of recording-permitted pixels in the increments is controlled in the present embodiment. Further, the average number of recording-permitted pixels in the increments in logical sum patterns obtained as the logical sum of the recording-permitted pixels in at least two of the multiple mask patterns is also controlled. Recording is performed while suppressing both color unevenness due to beading and formation of ink non-discharge regions due to deviation by controlling these values to suitable numbers.

This control method will be described next. FIGS. 13A through 13D are diagrams for describing the definition of increments of recording-permitted pixels in the present embodiment, and the average number of recording-permitted pixels within increments of recording-permitted pixels.

Figure 13A:
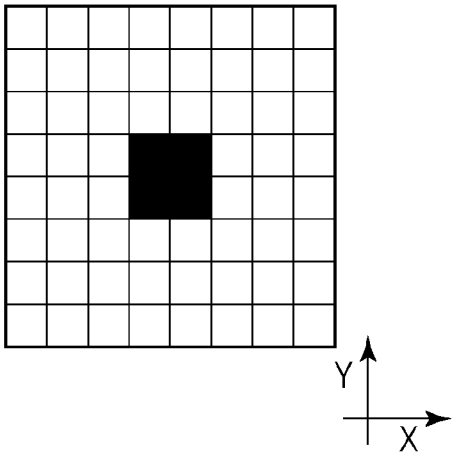
FIGS. 13A through 13D are schematic diagrams for describing increments of recording-permitted pixels according to the first embodiment.

As described above, a recording-permitted pixel group is made up of multiple recording-permitted pixels laid out at positions adjacent in the X direction or Y direction. For example, FIG. 13A illustrates a recording-permitted pixel group having a square shape, made up of four pixels, 2 pixels in the X direction and 2 pixels in the Y direction (2×2). In this case, the number of recording-permitted pixels within the increment is four.

Figure 13B:
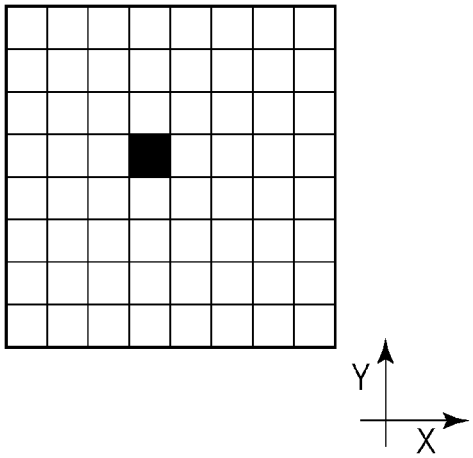

Also, a recording-permitted pixel which is adjacent to no other recording-permitted pixels is also called a recording-permitted pixel increment in the present embodiment. FIG. 13B illustrates a recording-permitted pixel with not adjacent recording-permitted pixels. In this case, the number of recording-permitted pixels within the increment is one.

Figure 13C:
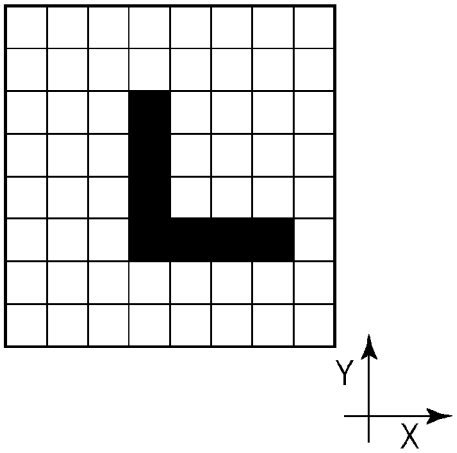

The present embodiment further includes as recording-permitted pixel groups of adjacent recording-permitted pixels which are continuous disproportionately in a certain direction, and is not restricted to isotropic shapes as illustrated in FIG. 13A. FIG. 13C illustrates an L-shaped recording-permitted pixel group disproportionately continuous in certain directions. In this case, the number of recording-permitted pixels within the increment is seven.

Figure 13D:
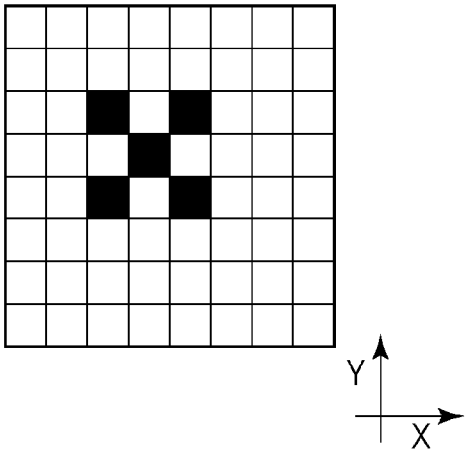

The term "adjacent recording-permitted pixels" in the present embodiment is restricted to recording-permitted pixels which are continuous in the X and Y directions, and does not include recording-permitted pixels which are adjacent diagonally. That is to say, each recording-permitted pixel may have as many as four recording-permitted pixels situated adjacently, two in the X direction and two in the Y direction. FIG. 13D illustrates five recording-permitted pixels which are adjacent diagonally. According to the above description, recording-permitted pixels which are adjacent diagonally do not constitute an increment, so these five recording-permitted pixels are each evaluated as making of separate increments. Accordingly, the number of recording-permitted pixels in each increment of the five recording-permitted pixels illustrated in FIG. 13D is one.

Figure 14A:
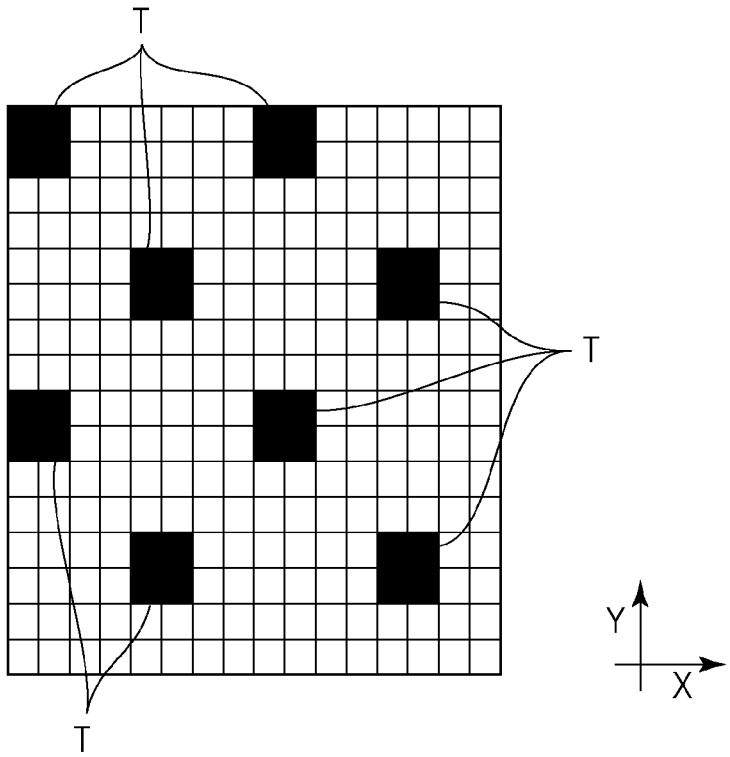
FIGS. 14A and 14B are diagrams for describing evaluation regions in a mask pattern according to the first embodiment.
Figure 14B:
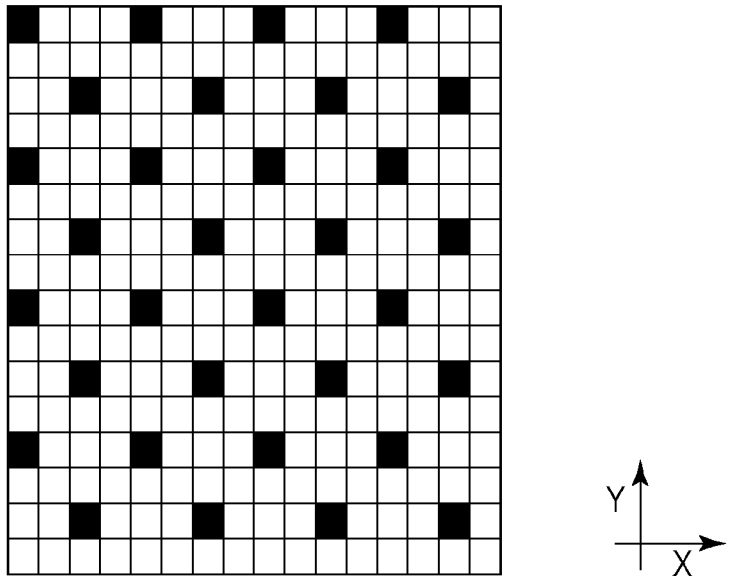

FIGS. 14A and 14B are diagrams for describing the calculation method of the average number of recording-permitted pixels within an increment of recording-permitted pixels according to the present embodiment. For sake of simplification, in the present embodiment the average number of recording-permitted pixels in recording-permitted pixel groups is calculated within an evaluation region of a predetermined pixel count within the unit region 80, and this value is used as the average number of recording-permitted pixels in the increments of the recording-permitted pixels within the unit region 80. FIGS. 14A and 14B exemplifies an evaluation region of 256 pixels, 16 pixels in the X direction and 16 pixels in the Y direction, as a mask pattern region corresponding to the evaluation region in the unit region 80. The average number of recording-permitted pixels within the increments is obtained in the present embodiment by calculating the number of increments included in the mask pattern corresponding to the evaluation region, and calculating the number of recording-permitted pixels in each increment within the mask pattern corresponding to the evaluation region. The sum of the number of recording-permitted pixels in each increment is further calculated, and a value obtained by dividing this sum by the number of increments is taken as the average number of recording-permitted pixels in the increments in each mask pattern.

For example, eight increments T, each of four recording-permitted pixels adjacent to each other, are formed in the mask pattern corresponding to the unit region illustrated in FIG. 14A. Accordingly, the average number of recording-permitted pixels in the increments of the mask pattern illustrated in FIG. 14A is four, obtained by dividing the sum of the number of the recording-permitted pixels in the increments which is 32 from 4×8, by 8 which is the number of increments.

On the other hand, there are not mutually adjacent recording-permitted pixels in the region of the mask pattern corresponding to the evaluation region illustrated in FIG. 14B. According to the above-described definition, there are a total number of 32 increments, of which the number of recording-permitted pixels within each increment is one. Accordingly, the average number of recording-permitted pixels in the increments of the mask pattern illustrated in FIG. 14B is one, obtained by dividing the sum of the number of the recording-permitted pixels in the increments which is 32 from 1×32, by 32 which is the number of increments.

Figure 15:
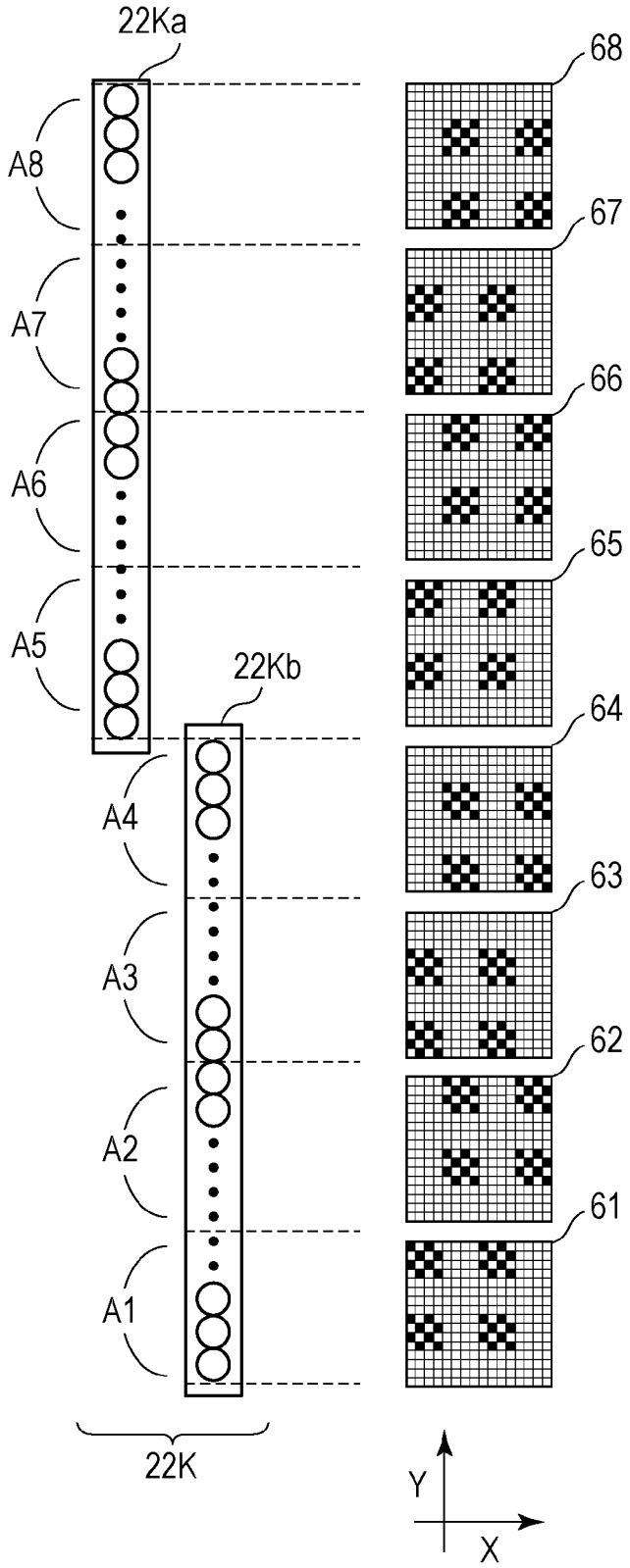
FIG. 15 is a diagram for describing mask patterns applied to the first embodiment.

Mask patterns applied in the present embodiment will be described next in detail. FIG. 15 is a diagram illustrating mask patterns applied to the discharge orifice row 22K for black ink.

Mask pattern 61 through mask pattern 68 are applied to discharge orifice group A1 through discharge orifice group A8 of the discharge orifice row 22K for black ink, respectively. While FIG. 15 illustrates mask patterns configured of 256 pixels, 16 in the X direction and 16 in the Y direction, for sake of brevity, it should be noted that this represents repetitive increments of the mask patterns. In practice, the mask patterns illustrated in FIG. 15 are repeated in the X direction and Y direction.

Each mask pattern of the mask pattern 61 through the mask pattern 68 has the same number of recording-permitted pixels, which is 32. Note that the recording-permitted pixels of the mask patterns 61 through 68 are each at different positions, and laid out so that the OR of all eight mask patterns is true at each pixel position.

Applying such mask patterns allows approximately the same amount of black ink to be discharged in each of the first through eight recording scans. Further, black ink can be applied to all positions within the unit region on the recording medium to which discharging can be performed by the first through eight recording scans.

Each of the mask patterns 61 through 68 do not have recording-permitted pixels adjacent in the X direction or the Y direction. That is to say, there are a total of 32 increments, of which the number of recording-permitted pixels within the increment is 1. Accordingly, calculating the average number of recording-permitted pixels within the increments in each pattern according to the above-described calculation method yields 1 as the average number of recording-permitted pixels within the increments in each mask pattern.

The eight mask patterns illustrated in FIG. 15 are set having a first pixel region where eight recording-permitted pixels and eight recording-not-permitted pixels are laid out, and a second pixel region where 16 recording-not-permitted pixels are laid out. The first and second pixel regions will be described using the mask pattern 61 as an example.

Figure 16:
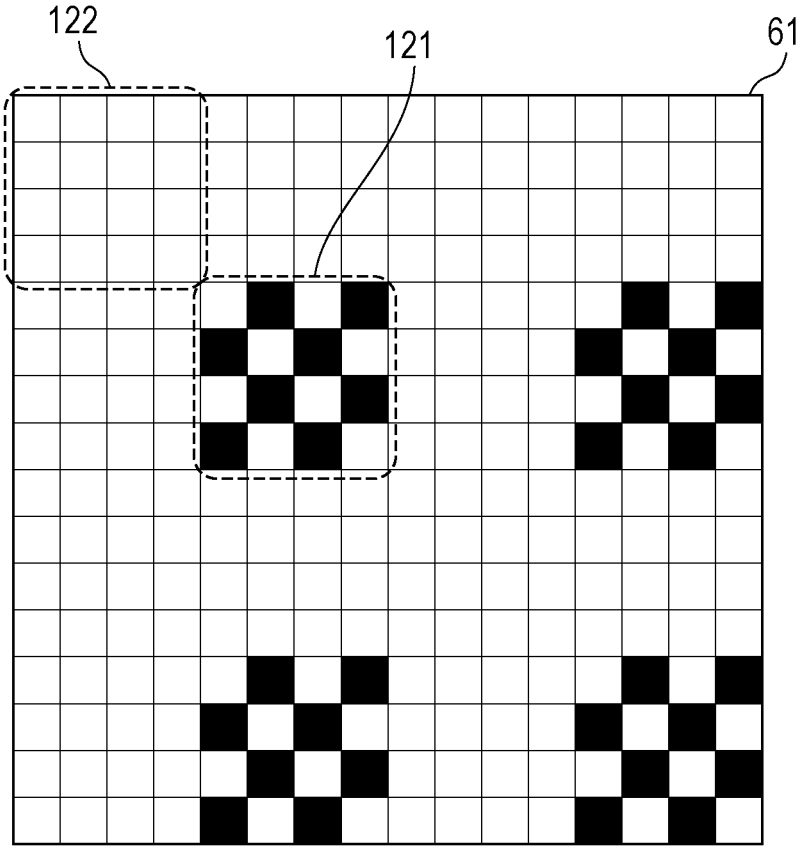
FIG. 16 is a diagram for describing pixel regions in mask patterns according to the first embodiment.

FIG. 16 is a diagram for describing the first and second pixel regions in the mask pattern 61. The first pixel region according to the present embodiment is a region in the mask pattern in which recording-permitted pixels are situated, with recording-permitted pixels and/or recording-not-permitted pixels situated at the perimeter thereof. The second pixel region according to the present embodiment is a region which has the same size as the first pixel region, in which all pixels in the region are recording-not-permitted pixels.

As can be seen from FIG. 16, the mask pattern 61 has four first pixel regions 121 and twelve second pixel regions 122, each having a 16-pixel×16-pixel range. Each of the first and second pixel regions have a 4-pixel×4-pixel size. Each of the mask patterns 61 through 68 are configured including four first pixel regions 121 and twelve second pixel regions 122 within a 16-pixel×16-pixel range, as can be seen from FIG. 15.

Further, the mask patterns 61 and 65 applied at the discharge orifice groups A1 and A5 have the first pixel regions 121 formed at the same positions. In the same way, the mask patterns 62 and 66 applied at the discharge orifice groups A2 and A6, the mask patterns 63 and 67 applied at the discharge orifice groups A3 and A7, and the mask patterns 64 and 68 applied at the discharge orifice groups A4 and A8, also have the first pixel regions 121 formed at the same positions.

Hereinafter, the mask patterns 61 and 65 the first pixel regions 121 are formed at the same positions will be classified as a first mask pattern group, the mask patterns 62 and 66 as a second mask pattern group, the mask patterns 63 and 67 as a third mask pattern group, and the mask patterns 64 and 68 as a fourth mask pattern group.

FIGS. 17A through 17D are diagrams illustrating logical sum patterns obtained as the logical sum of the two mask patterns classified in the same mask pattern groups with regard to multiple recording-permitted pixels, for all eight mask patterns illustrated in FIG. 15. The mask patterns according to the present embodiment are set such that the average number of recording-permitted pixels within the increments described above, in the logical sum patterns obtained as the logical sum regarding recording-permitted pixels of two mask patterns classified in the same mask pattern group, is greater than a predetermined threshold value.

The logical sum patterns according to the present embodiment represent multiple mask patterns having been overlaid, in which recording-permitted pixels are laid out at positions where recording-permitted pixels are laid out in any one of the mask patterns, and recording-not-permitted pixels are laid out at position where recording-not-permitted pixels are recorded in all of the mask patterns.

Figure 17A:
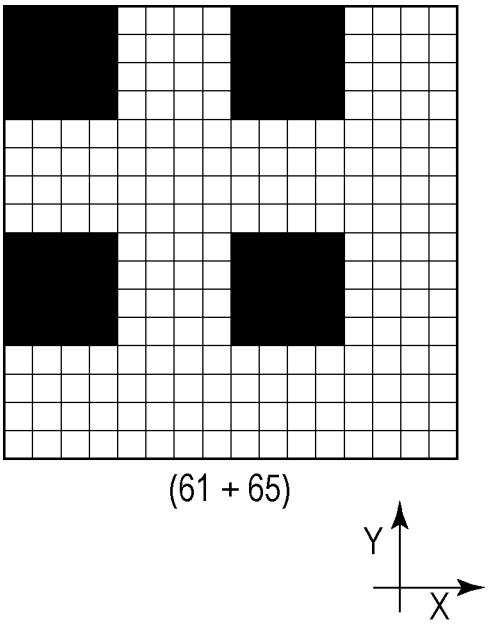
FIGS. 17A through 17D are diagrams for describing logical sum patterns according to the first embodiment.

FIG. 17A illustrates a first logical sum pattern obtained as the logical sum of the mask pattern 61 applied to the discharge orifice group A1 corresponding to the first scan illustrated in FIG. 15 with the recording-permitted pixels laid out therein, and the mask pattern 65 applied to the discharge orifice group A5 corresponding to the fifth scan with the recording-permitted pixels laid out therein. The first logical sum pattern has configured therein four increments of recording-permitted pixels, each made up of 16 recording-permitted pixels adjacent to each other in the X direction or Y direction. Accordingly, the average number of recording-permitted pixels in the increments, calculated by the above calculation method, is 16 (16×4/4).

Thus, in the region corresponding to the first pixel region in the first logical sum pattern, recording-permitted pixels are laid out at all portions. Note that it is sufficient for recording-permitted pixels to be situated at almost at all portions in the region corresponding to the first pixel region in the first logical sum pattern. Also, the dispersiveness of the recording-permitted pixels in the first logical sum pattern is set so as to be lower than the dispersiveness of the recording-permitted pixels in either of the mask patterns 61 and 65 in the first mask pattern group. Note that in the present embodiment, the dispersiveness of the recording-permitted pixels is evaluated as being low in a case where the above-described average number of recording-permitted pixels in the increments is great.

Figure 17B:
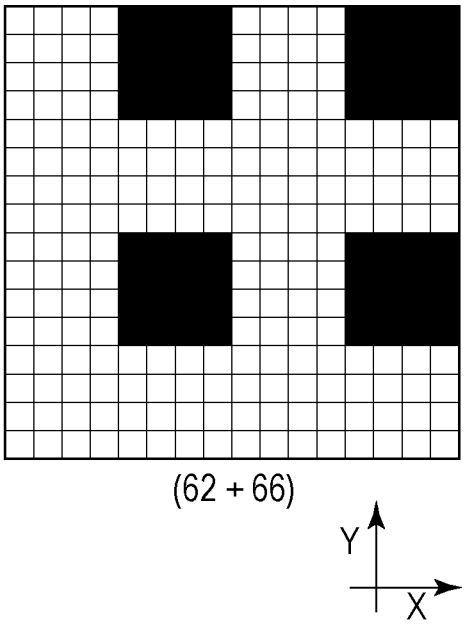
Figure 17C:
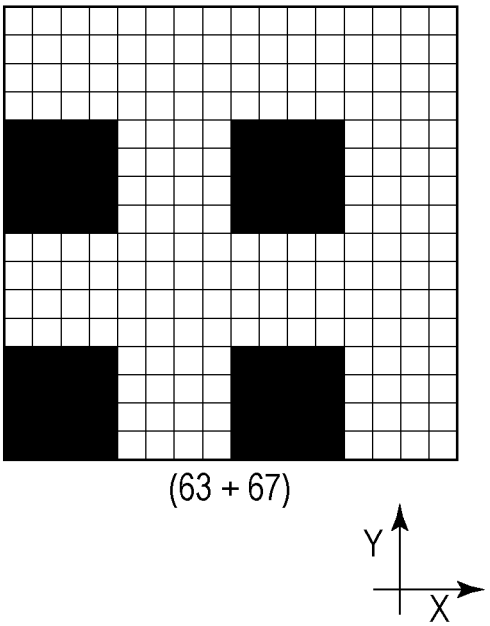
Figure 17D:
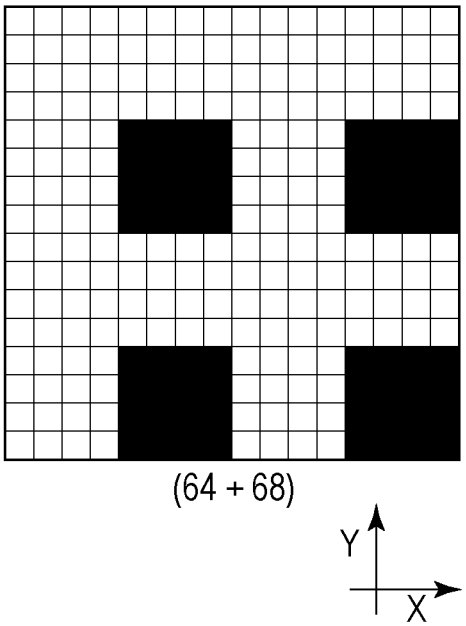

In the same way, FIGS. 17B through 17D respectively illustrate a second logical sum pattern obtained as the logical sum of the mask patterns 62 and 66 classified in the second mask pattern group, a third logical sum pattern obtained as the logical sum of the mask patterns 63 and 67 classified in the third mask pattern group, and a fourth logical sum pattern obtained as the logical sum of the mask patterns 64 and 68 classified in the fourth mask pattern group, each illustrated in FIG. 15. The average number of recording-permitted pixels in the increments, calculated by the above calculation method, is 16, for each of the second, third, and fourth logical sum patterns as well.

As described above, mask patterns are applied with recording-permitted pixels laid out such that the average number of recording-permitted pixels in the increments in each mask pattern is one, and the average number of recording-permitted pixels in the increments in each logical sum pattern corresponding to the two mask patterns classified in the same mask pattern group is 16, in the present embodiment. Accordingly, recording can be performed while suppressing both color unevenness due to beading, and formation of non-discharge regions due to deviation in conveyance and so forth.

Description will be made next regarding an estimation mechanism whereby both color unevenness due to beading and formation of non-discharge regions due to deviation in conveyance and so forth can be suppressed, by applying the above-described mask patterns. First, an estimation mechanism regarding suppressing color unevenness due to beading will be described.

FIGS. 18A through 18F are diagrams illustrating the processes of performing recording by applying the mask patterns illustrated in FIG. 15 to the discharge orifice groups in each scan. FIGS. 18A through 18F represent images formed at the point that the first, second, third, fourth, fifth, and eighth scans have ended.

Figure 18A:
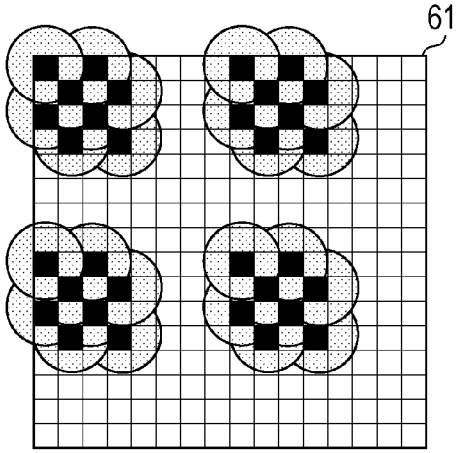
FIGS. 18A through 18F are diagrams for describing the processes of recording according to the first embodiment.

At the first scan, eight ink droplets are formed at positions on the recording medium in contact with each other, as illustrated in FIG. 18A. These eight ink droplets draw each other together before being fixed onto the recording medium by heating, and form one large ink droplet. However, the large ink droplets formed in the same scan are not in contact with each other, so beading among large ink droplets can be suppressed.

Figure 18B:
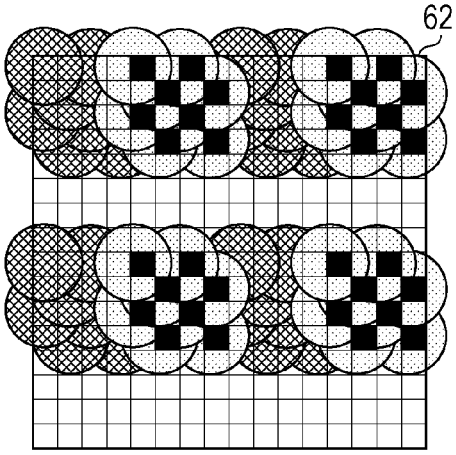

At the second scan as well, eight ink droplets are formed at positions on the recording medium in contact with each other, as illustrated in FIG. 18B. Accordingly, large ink droplets are formed in the same way as with the first scan, but beading between the large ink droplets can be suppressed. While the ink droplets formed in the second scan come into contact with the ink droplets formed in the first scan, the ink droplets formed in the first scan have already been fixed to a certain extend by the time the second scan is performed, so there is no beading occurring between the ink droplets formed in the first and second scans.

Figure 18C:
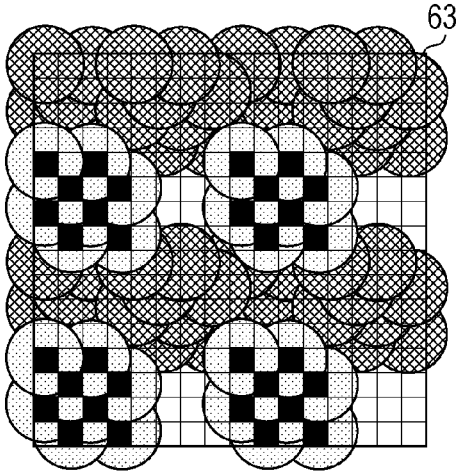
Figure 18D:
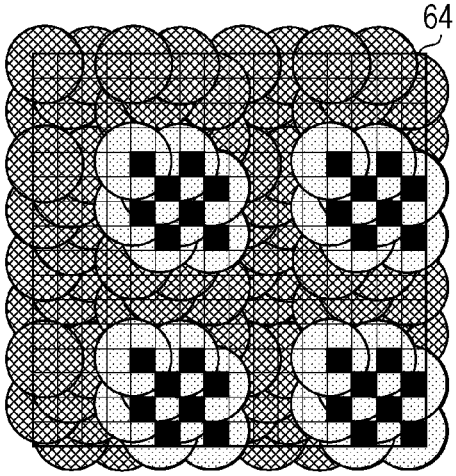

Thereafter, the third and fourth scans are performed as illustrated in FIGS. 18C and 18D. at the point that the fourth scan has been performed, ink droplets cover all unit regions on the recording medium as illustrated in FIG. 18D, and hardly any white spots (regions where the front surface of the recording medium can be recognized) exist.

Figure 18E:
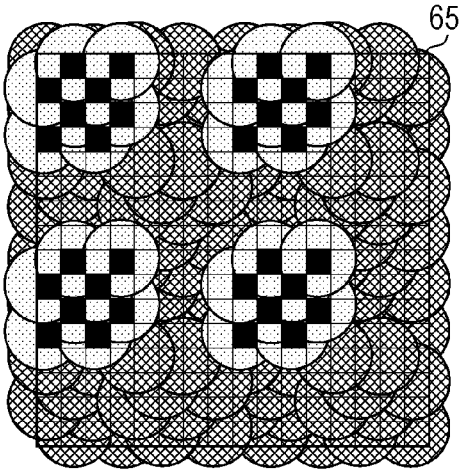
Figure 18F:
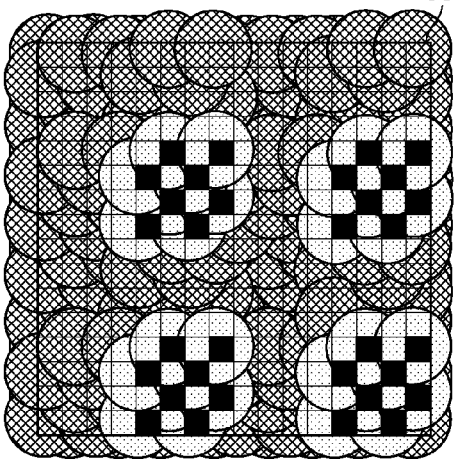

In the fifth scan, ink droplets are formed at the positions indicated in FIG. 18E. The ink droplets formed in the fifth scan are almost at the same position as the ink droplets formed in the first scan, but actually are formed at slightly different positions. In the same way, the sixth, seventh, and eight scans are performed, and after the eighth scan is performed, forming of the image ends as illustrated in FIG. 18F.

As described above, contact between large ink droplets formed in each scan can be suppressed by applying the mask patterns according to the present embodiment, so recording can be performed while suppressing occurrence of beading.

Figure 19A:
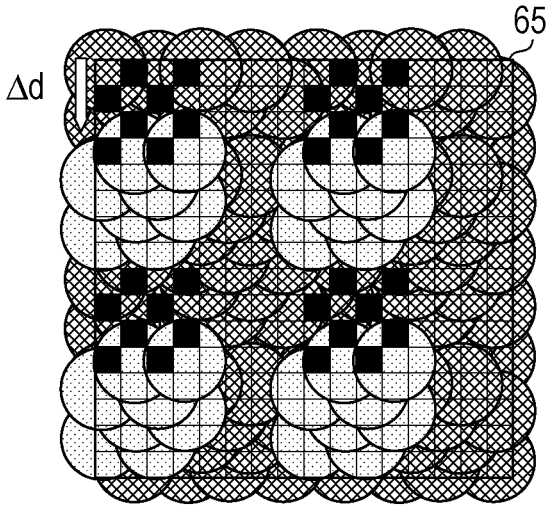
FIGS. 19A and 19B are diagrams for describing deviation due to conveyance or the like, according to the first embodiment.
Figure 19B:
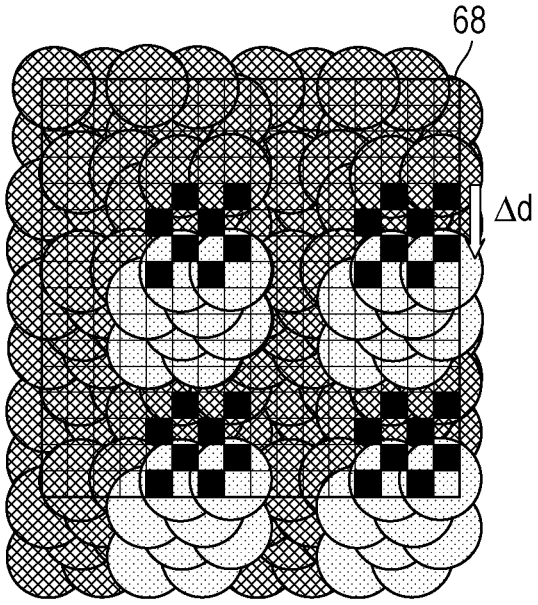

Next, an estimation mechanism regarding suppressing formation of non-discharge regions due to deviation in conveyance and so forth will be described. FIGS. 19A and 19B are diagrams illustrating images formed in a case where conveyance deviation of the recording medium has occurred between the fourth and fifth scans. Here, a case will be exemplified where the conveyance amount of the recording medium is shorter than the standard conveyance amount d by a length Δd, which corresponds to three discharge orifices worth. The images formed up to the fourth scan are the same as those in FIGS. 18A through 18D, and accordingly description thereof will be omitted.

FIG. 19A illustrates an image where conveyance deviation has occurred between the fourth and fifth scans, and subsequently the fifth scan has been performed. This conveyance deviation causes the ink droplets to be formed at positions shifted upstream in the Y direction by the amount Δd, as compared to the image formed in a case where no conveyance deviation has occurred, as illustrated in FIG. 18E. This may cause slight unevenness in the final image. However, all regions on the recording medium have been covered by ink droplets by the first through fourth scans, as illustrated in FIG. 18D, so conveyance deviation between the fourth and fifth scans will not form white spots in the image.

FIG. 19B illustrates the image after recording has been further performed and the eighth scan has been performed. Description will be made here regarding a case where no conveyance deviation occurs after the fifth scan.

The scans after the fifth scan are still under the effect of the above-described conveyance deviation, so ink droplets are formed at positions shifted upstream in the Y direction by the amount Δd, as compared to the intended positions to form the ink droplets. However, no white spots are formed in the image, the same as with the fifth scan above. Accordingly, no white spots are formed in the finally obtained image, and thus deterioration in image quality can be suppressed.

Figure 20:
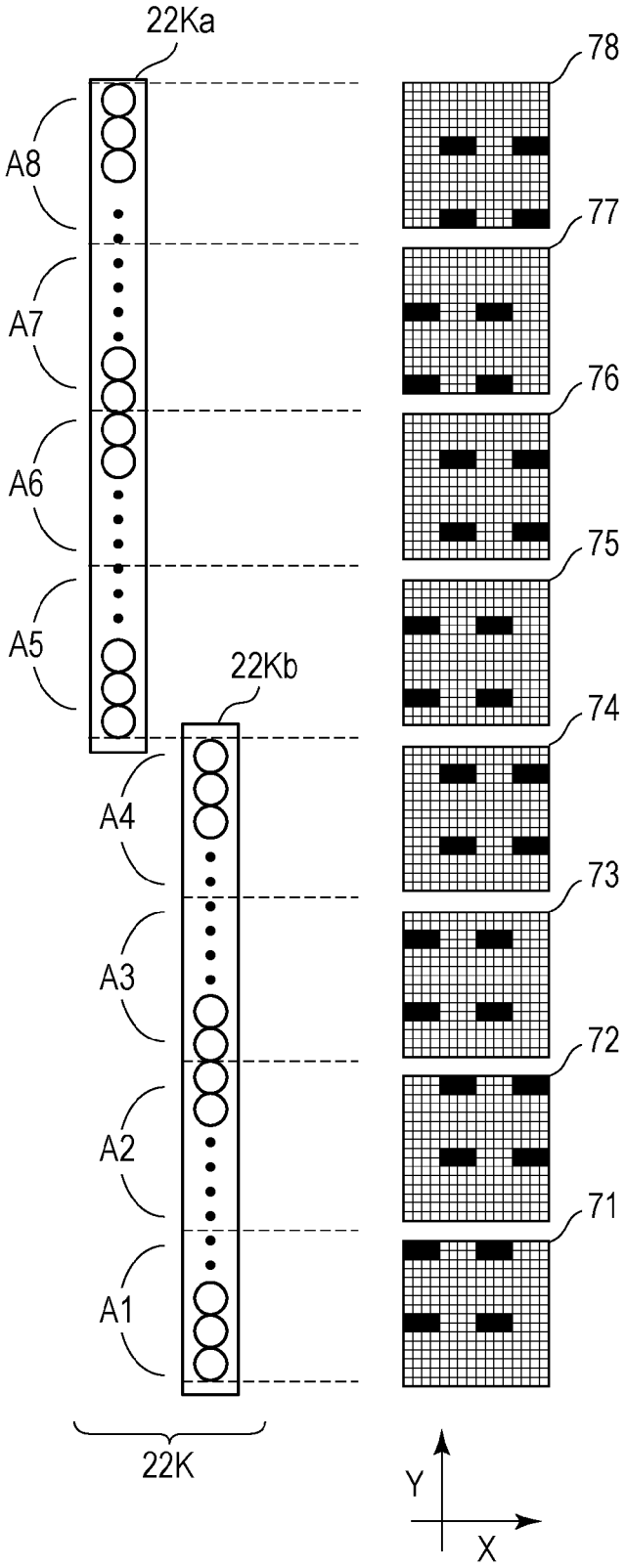
FIG. 20 is a diagram illustrating mask patterns to be applied to a comparative embodiment.

Next, a comparative embodiment to suppress formation of non-discharge regions due to the above-described deviation in conveyance or the like, will be described. FIG. 20 is a diagram illustrating mask patterns applied in the comparative embodiment. FIGS. 21A through 21D are diagrams illustrating an image in a case of conveyance deviation having occurred between the fourth and fifth scans in a case where the mask patterns illustrated in FIG. 20 have been applied to record the image. FIGS. 21A through 21D respectively illustrate the image after having performed the first, fourth, fifth and eighth scans. A case will be described here where the conveyance amount of the recording medium is shorter than the standard conveyance amount d by the length Δd, which is a deviation amount which corresponds to three discharge orifices worth, in the same way as that illustrated in FIG. 19A.

The mask patterns illustrated in FIG. 20 have the same number of recording-permitted pixels as the number of recording-permitted pixels in the mask patterns illustrated in FIG. 15, which is 32. In the comparative example in FIG. 20, each of the eight mask patterns applied to each discharge orifice group in each scan are arranged such that the average number of recording-permitted pixels in the above-described increments is four.

Figure 21A:
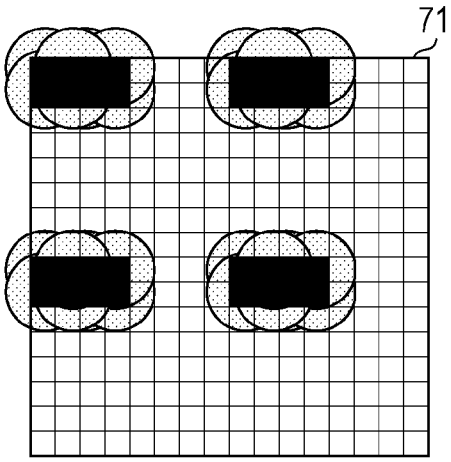
FIGS. 21A through 21D are diagrams for describing deviation due to conveyance or the like, according to the comparative embodiment.

In the first scan, eight ink droplets are formed at positions in contact with each other, forming a large ink droplet, as illustrated in FIG. 21A. Accordingly, the large ink droplet can be formed at positions not in contact with each other in the comparative embodiment as well, so beading among the large ink droplets can be suppressed.

Figure 21B:
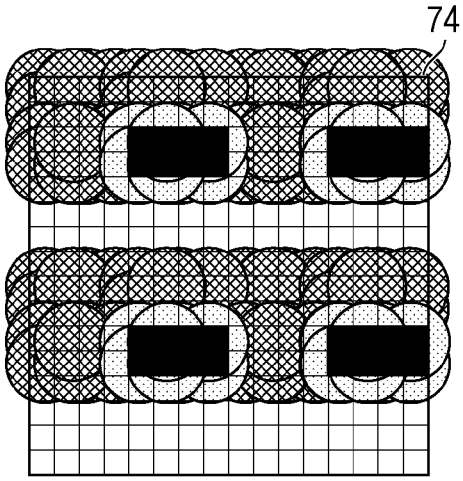
Figure 21C:
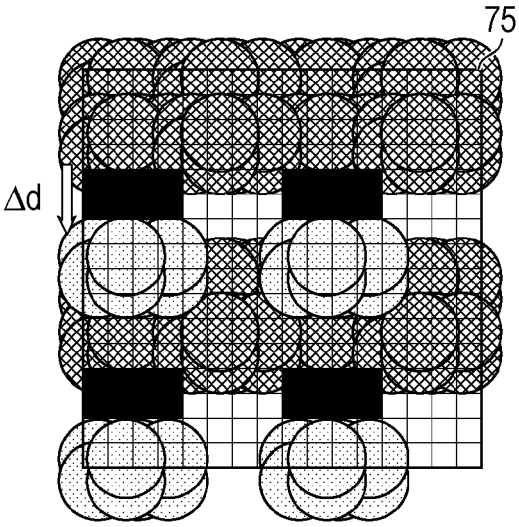
Figure 21D:
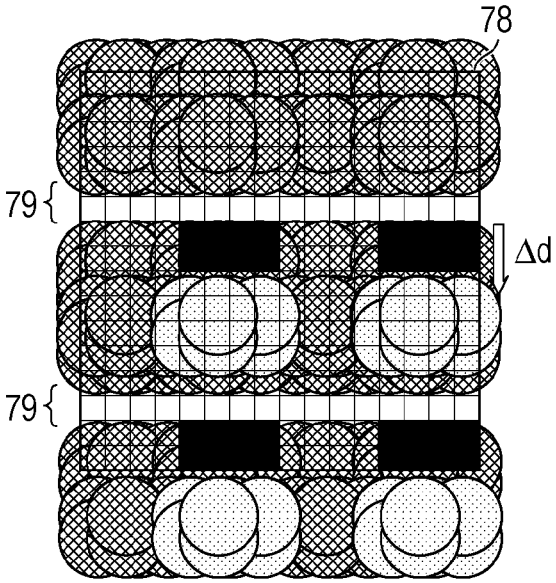

However, a region which is not covered with ink yet even after four scans is formed on the recording medium in a case of performing recording using the mask patterns according to the comparative embodiment, as illustrated in FIG. 21B. Accordingly, white spots due to the effect of conveyance deviation may appear such as illustrated in FIG. 21C, in a case that conveyance deviation by Δd occurs between the fourth and fifth scans. This leaves a region 79 on the recording medium not covered by ink droplets even after the eight scan has been performed and recording of the image has ended, as illustrated in FIG. 21D. This region 79 is visually recognized as a white spot, markedly deteriorating the image quality of the image.

As described above, formation of non-discharge regions (white spots) in the final image, due to deviation in conveyance and so forth, can be suppressed by applying the mask patterns according to the present embodiment. Accordingly, both color unevenness due to beading, and occurrence of non-discharge regions due to deviation in conveyance and so forth, can be effectively suppressed in image recording by the configuration according to the present embodiment.

Second Embodiment

Description has been made in the first embodiment regarding a configuration where a so-called joint head is used, which has multiple discharge orifice rows arrayed in the Y direction. Conversely, a second embodiment will be described where recording is performed using a recording head made up of a single discharge orifice row. Note that description of portions which are the same as those described in the first embodiment above will be omitted here.

Figure 22:
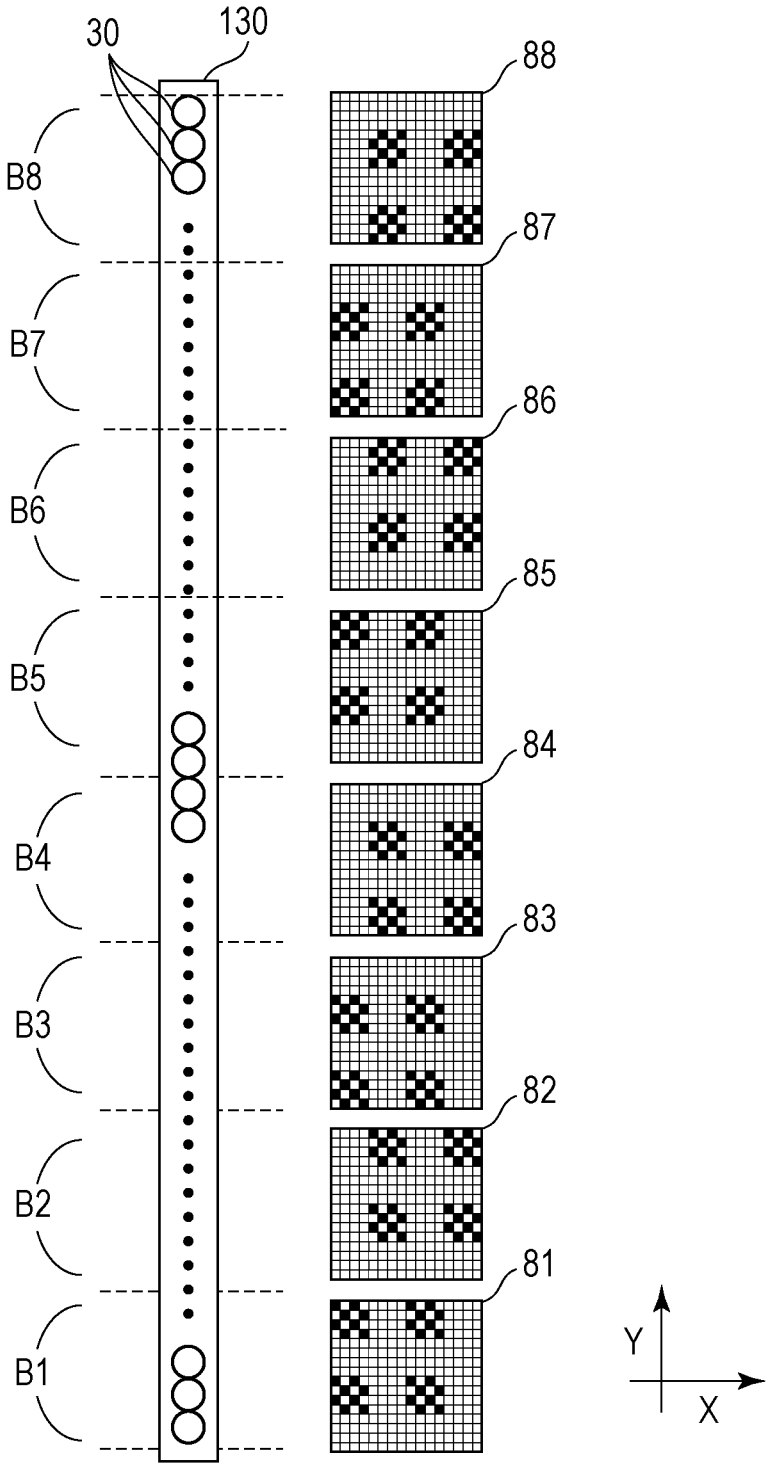
FIG. 22 is a diagram illustrating mask patterns to be applied to a second embodiment.

FIG. 22 is a schematic diagram illustrating a recording head used in the present embodiment and mask patterns applied in the present embodiment. A recording head 130, having 1,280 discharge orifices 30 for discharging ink arrayed in the Y direction, is used in the present embodiment. These discharge orifices 30 are divided into eight discharge orifice groups B1 through B8, each having 160 discharge orifices 30. An image is recorded by performing eight scans as to a unit region on the recording medium, with the discharge orifice groups B1 through B8 each discharging ink one time as to the unit region. The recording medium is conveyed by a distance corresponding to the length of one discharge orifice group in the Y direction, in between each of the above-described eight scans.

Each of the above-described eight scans performs recording applying mask patterns 81 through 88 for each of the discharge orifice groups B1 through B8, corresponding to the respective scans. The layout of the recording-permitted pixels in the mask patterns 81 through 88 is the same as the layout of the recording-permitted pixels in the mask patterns 61 through 68 in the first embodiment illustrated in FIG. 15.

Applying the mask patterns according to the present embodiment enables ink to be discharged in each scan so that large ink droplets formed of multiple ink droplets do not come into contact with each other, so beading between large ink droplets can be suppressed. Further, almost the entire region of the unit region is covered with ink droplets at the point that the fourth scan has ended, so even in a case where deviation in conveyance occurs in subsequent scans, recording can be performed without forming non-discharge regions of ink.

Third Embodiment

Description has been made in the first and second embodiments regarding a configuration where two out of multiple mask patterns corresponding to the scans are classified in one mask pattern group. Conversely, a third embodiment will be described where three mask patterns are classified in one mask pattern group. Note that description of portions which are the same as those described in the first and seconds embodiments above will be omitted here.

Figure 23:
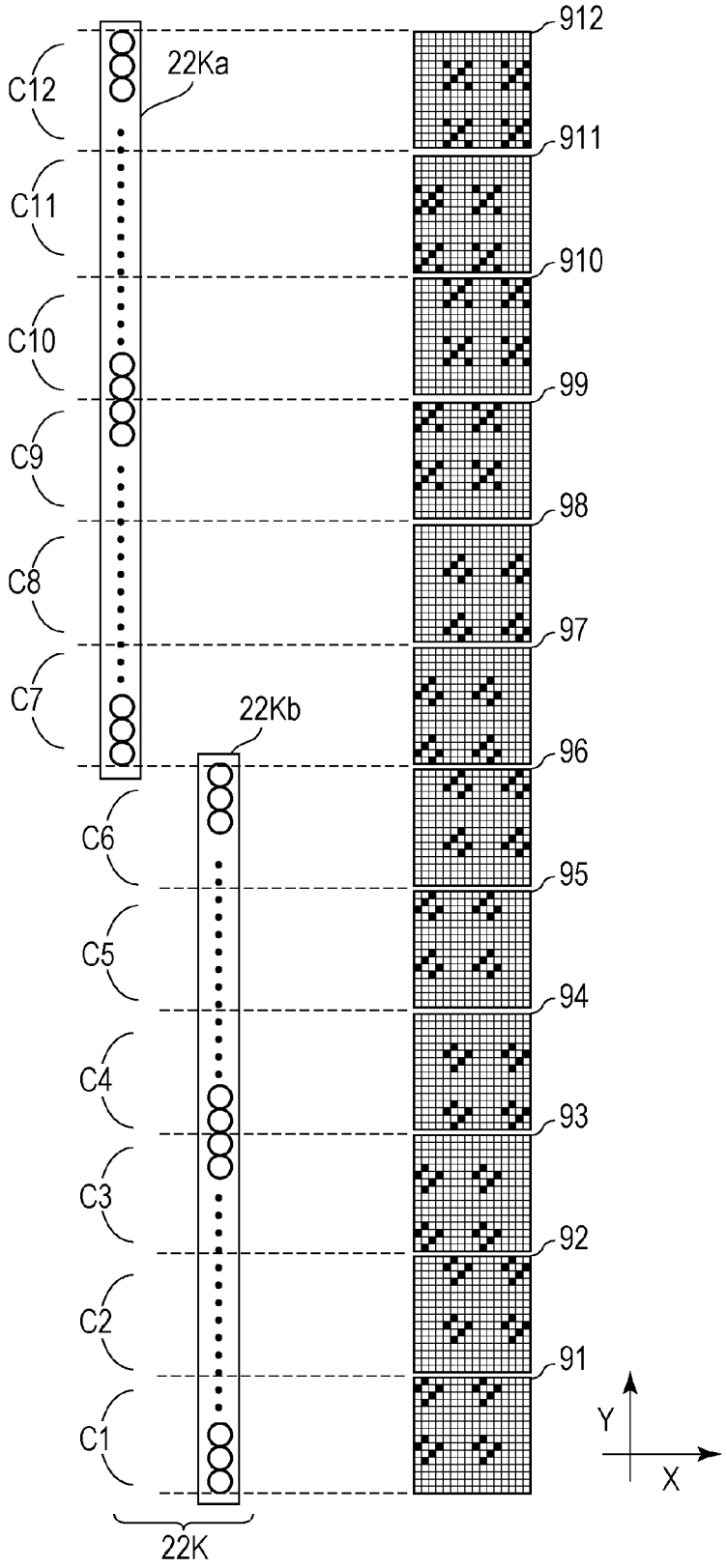
FIG. 23 is a diagram illustrating mask patterns to be applied to a third embodiment.

FIG. 23 is a diagram of mask patterns applied in the present embodiment. An image is recorded by performing twelve scans as to a unit region on the recording medium in the present embodiment. Note that the recording head used in the present embodiment is the same as the recording head used in the first embodiment.

The rows 22Ka and 22Kb in the recording head used in the present embodiment are each divided into six discharge orifice groups, discharge orifice group C1 through discharge orifice group C6, and discharge orifice group C7 through discharge orifice group C12. Recording is performed on the unit region by discharging ink one time each from each of the twelve discharge orifice groups C1 through C12, in the twelve scans as to the unit region on the recording medium. The discharge orifice groups discharge ink in their respective scans according to the twelve mask patterns 91 through 912 illustrated in FIG. 23.

The twelve mask patterns 91 through 912 applied in the present embodiment are set such that multiple recording-permitted pixels are not adjacent in the X direction or the Y direction, as illustrated in FIG. 23. Accordingly, the above-described average number of recording-permitted pixels in the increments of the mask patterns 91 through 912 is one.

The mask patterns 91, 95, and 99 have first pixel regions formed each at the same position. In the same way, the sets of the mask patterns 92, 96, and 910, the mask patterns 93, 97, and 911, and the mask patterns 94, 98, and 912 have first pixel regions formed each at the same position.

Accordingly, the twelve mask patterns applied in the present embodiment are classified into four mask pattern groups. These are a first mask pattern group made up of mask patterns 91, 95, and 99, a second mask pattern group made up of mask patterns 92, 96, and 910, a third mask pattern group made up of mask patterns 93, 97, and 911, and a fourth mask pattern group made up of mask patterns 94, 98, and 912.

The mask patterns according to the present embodiment are set such that the average number of recording-permitted pixels within the increments described above, in the logical sum patterns obtained as the logical sum regarding recording-permitted pixels of the three mask patterns classified in the same mask pattern group, is greater than a predetermined threshold value. Specifically, the logical sum patterns corresponding to the three mask patterns classified in the first, second, third, and fourth mask pattern groups are such as illustrated in FIGS. 17A through 17D, respectively. Accordingly, the average value of recording-permitted pixels in the increments of the logical sum patterns is 16, the same as with the first embodiment.

When recording applying the mask patterns described in the present embodiment, ink droplets discharged in one scan land at nearby positions on the recording medium, so large ink droplets are formed, but the large ink droplets do not come into contact with each other, so beading amount large ink droplets can be suppressed.

Also, after the fourth scan is performed, a great portion of the recording medium can be covered by ink, although the coverage area is smaller than in a case of having applied the mask patterns according to the first embodiment. Accordingly, non-discharge regions of ink are not readily formed even if conveyance deviation occurs in subsequent scans or there is deviation in placement of discharge orifice rows, so recording can be performed in which color displacement does not readily occur.

Further, when recording using the mask patterns according to the present embodiment, the number of ink droplets formed at nearby positions is five or six, which is fewer than the eight ink droplets making up a large ink droplet according to the mask patterns of the first embodiment. Accordingly, smaller large ink droplets can be formed by the mask patterns according to the present embodiment, so images with less graininess can be recorded as compared to the first embodiment.

Fourth Embodiment

Description has been made in the first through third embodiments regarding a configuration where mask patterns are set taking into consideration only one discharge orifice row corresponding to a single color. Conversely, a fourth embodiment will be described regarding a configuration where mask patterns are set taking into consideration multiple discharge orifice rows corresponding to multiple colors.

The recording head used in the present embodiment is the same as the recording head used in the first embodiment. The discharge orifice row 22K which discharges black ink performs recording applying each of the mask patterns illustrated in FIG. 15 according to the first embodiment to the respective discharge orifice groups in the respective scans.

Figure 24:
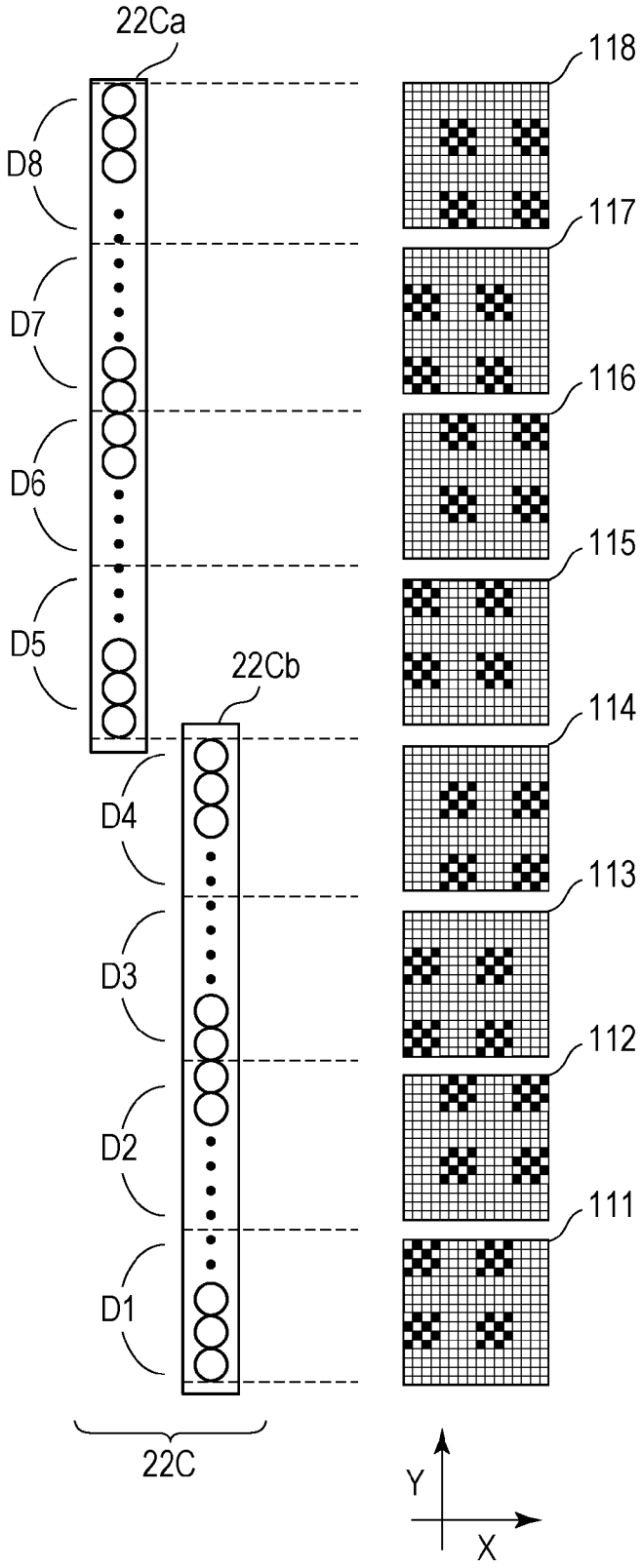
FIG. 24 is a diagram illustrating mask patterns to be applied to a fourth embodiment.

FIG. 24 is a diagram for describing mask patterns to be applied to discharge orifice rows which discharge cyan ink in the present embodiment. Rows 22Ca and 22Cb in the discharge orifice row 22C which discharges cyan ink in the present embodiment are each divided into four discharge orifice groups, discharge orifice group D1 through discharge orifice group D4, and discharge orifice group D5 through discharge orifice group D8. The discharge orifice row 22K and the discharge orifice row 22C are arrayed in the X direction as illustrated in FIG. 12, so the discharge orifice groups D1 through D8, and the discharge orifice groups A1 through A8 each discharge ink at the unit region in the same respective scans. The eight mask patterns 111 through 118 illustrated in FIG. 24 are applied to the respective discharge orifice groups D1 through D8.

The mask patterns 111 through 118 applied to the discharge orifice rows which discharge cyan ink in the present embodiment are set such that multiple recording-permitted pixels are not adjacent in the X direction or the Y direction. Accordingly, the above-described average number of recording-permitted pixels in the increments is one.

On the other hand, the mask patterns 111 through 118 are classified into the four mask pattern groups of a first mask pattern group made up of mask patterns 111 and 115, a second pattern group made up of mask patterns 112 and 116, a third mask pattern group made up of mask patterns 113 and 117, and a fourth mask pattern group made up of mask patterns 114 and 118. The logical sum patterns corresponding to the two mask patterns classified in the first, second, third, and fourth mask pattern groups are such as illustrated in FIGS. 17A through 17D, respectively. Accordingly, the average value of recording-permitted pixels in the increments of the logical sum patterns is 16, the same as with the logical sum patterns corresponding to the black ink.

Comparing the mask patterns 61 and 111, applied to the discharge orifice groups A1 and D1 corresponding to the first scan as illustrated in FIGS. 15 and 24 respectively, it can be seen that the first pixel region in both are configured at the same position, while the recording-permitted pixels of each are formed at mutually exclusive positions. Accordingly, in a case of discharging ink according to the mask patterns 61 and 111 as illustrated in FIGS. 15 and 24 respectively, the large ink droplets of black ink and the large ink droplets of cyan ink are formed at approximately the same position on the recording medium. Accordingly, one large ink droplet each of black ink and cyan ink may come into contact with each other on the recording medium and cause beading. However, there is no further contact of large ink droplets on the recording medium, so beading can be suppressed to a certain extent. Further, the positions on the recording medium where the large ink droplets of black ink and cyan ink are formed are approximately the same, but slightly different. Accordingly, recording with suppressed graininess and moiré to a certain extent can be performed as compared to a case where the black ink and cyan ink are formed on the same positions on the recording medium.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While description has been made in the above embodiments regarding a configuration where the number of recording-permitted pixels adjacent in the diagonal direction intersecting the X direction and Y direction within the mask patterns is a fairly large number, other arrangements may be made. That is to say, it is sufficient for the mask patterns according to the present invention to be arranged such that the recording-permitted pixels in each of the regions, corresponding to regions where increments are formed in the logical sum patterns, are dispersed to a certain extent. For example, the advantages of the present invention can also be obtained by the recording-permitted pixels in regions corresponding to regions where increments are formed in the logical sum patterns being laid out in random mask patterns, or the recording-permitted pixels being laid out to have blue noise properties. It should be noted though, that the average number of recording-permitted pixels in increments in the respective logical sum patterns is preferably 16 or more. Further, the average number of recording-not-permitted pixels in increments in the respective logical sum patterns is preferably four or more.

Also, in the embodiments described above, representing the number of mask pattern groups by M, the logical sum patterns in the M mask patterns used in the M scans from the first scan to the M'th scan of a unit region are set so as to not include the second pixel region. For example, in the arrangement illustrated in FIG. 15, the number of mask pattern groups is four. The mask patterns 61 through 64 used for the respective first through fourth scans have the first pixel regions at different positions from each other, which is to say that the first pixel regions are configured at complementary positions. Accordingly, the logical sum patterns in the mask patterns 61 through 64 have the first pixel region formed over the entire region, and no second pixel region is included. This configuration of mask patterns allows ink to be discharged to the entire region of the recording medium at the earliest scan possible (M'th scan). Thus, occurrence of non-discharge regions can be effectively suppressed in a case where recording position deviation occurs in the M+1'th scan or a subsequent scan. Note however, that the present invention is not restricted to this arrangement, and the advantages of the present invention can be obtained as long as two mask patterns of the same mask pattern group are applied in two scans separated by a predetermined number of times which is two times or more. Note that the above predetermined number of times is preferably a number of times equivalent to N/M where N is the number of times the unit region is to be scanned.

Also, while description has been made in the above embodiments that all regions within the mask patterns are configured by first and second pixel regions, other arrangements may be made. For example, an arrangement may be made where a 16-pixel×16-pixel region within a mask pattern is configured including four first pixel regions, eleven second pixel regions, and one pixel region having a layout of one recording-permitted pixel and 15 recording-not-permitted pixels.

Also, while the embodiments have been described with regard to an arrangement where the number of ink droplets making up a large ink droplet formed when recording is performed applying the respective mask patterns is 5, 6, or 8, other arrangements may be made. The ink droplets need to be dispersed enough to where almost all of the regions on the recording medium can be covered with the several scans in the first half of the multiple scans, while at the same time the ink droplets need to be collected enough to where the large ink droplets do not come into contact with each other. Although the optimal number of ink droplets making up large ink droplets differs depending on the ink and type of recording medium, it has been found through experimentation that the advantages of the present invention can be had when the number of ink droplets is 8 or more but 200 or less.

While description has been made in the above embodiments that the average number of recording-permitted pixels within the increments in the mask patterns is one, other arrangements may be made. That is to say, there may be recording-permitted pixels situated at adjacent positions in the X direction or Y direction to a certain extent, as long as graininess is not conspicuous, so it is sufficient for this number to be smaller than a predetermined threshold. Although this predetermined threshold differs depending on the ink and type of recording medium used, the advantages of the present invention are manifested particularly prominently when the predetermined threshold is smaller than 8.

While description has been made in the embodiments regarding a recording apparatus which uses so-called thermosetting type ink which includes a resin emulsion, and which forms a film and is fixed to the surface of a water-absorption resistant recording medium by application of heat after ink droplets land, the present invention is not restricted to a recording apparatus which uses such thermosetting type ink. Rather, the present invention is effectively applicable to recording apparatuses in general which use a combination of ink and recording medium where the fixing time of the ink as to the recording medium is relatively long.

While description has been made in the embodiments regarding an ink-jet recording apparatus and recording method which is a so-called thermal jet type, that discharges ink by bubble generation due to heating, the present is in no way restricted to thermal jet type ink-jet recording apparatuses. Rather, the present invention is effectively applicable to a wide variety of image recording apparatuses, such as so-called piezo type ink-jet recording apparatus which discharge ink using piezoelectric transducers, for example.

Also, while description has been made in the embodiments regarding image recording methods using the image recording apparatus, other arrangements may be made. For example, the present invention may be widely applied to a data generating apparatus, a data generating method, or program, which are prepared separately from the recording apparatus, or are part of the recording apparatus, to generate data to perform the image recording method described in the embodiments.

According to the image recording apparatus, image recording method, and storage medium, which are an example of the present invention, both color unevenness due to beading, and occurrence of non-discharge regions due to deviation in conveyance, and so forth, can be effectively suppressed, and an image with good image quality can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-255201, filed Dec. 10, 2013, which is hereby incorporated by reference herein in its entirety.

What is claimed is:

1. An image recording apparatus which records images, comprising:

a recording head configured including at least one discharge orifice row in which a plurality of discharge orifices for discharging ink of a predetermined color are arrayed in an array direction;

a scanning unit configured to cause the recording head and a unit region on a recording medium to be scanned a plurality of times in a scanning direction which intersects the array direction;

a conveying unit configured to convey the recording medium a distance corresponding to a length in the array direction of each of a plurality of discharge orifice groups of a predetermined number of discharge orifices continuously arrayed in the array direction, configured as divisions of the plurality of discharge orifices in a conveying direction which intersects the scanning direction, the conveying being performed in between the plurality of scans of the recording head;

a generating unit configured to generate recording data so as to discharge ink to the unit region from the plurality of discharge orifice groups, in each of the plurality of scans of image data corresponding to the unit region performed as to the unit region, based on a plurality of mask patterns corresponding to each of the plurality of discharge orifice groups, in each of which mask patterns recording-permitted pixels determining permission of recording to the unit region and recording-not-permitted pixel determining non-permission of recording thereto have been laid out; and a recording control unit configured to discharge ink from each of the plurality of discharge orifice groups to the unit region in each of the plurality of scans, based on the recording data;

wherein, with regard to a first mask pattern group made up of at least two mask patterns out of the plurality of mask patterns, each mask pattern in the first mask pattern group includes a plurality of first pixel regions where a plurality of the recording-permitted pixels and a plurality of the recording-not-permitted pixels have been laid out, and a plurality of second pixel regions where only a plurality of recording-not-permitted pixels have been laid out, the plurality of first pixel regions in each of the mask patterns in the first mask pattern group are configured at mutually corresponding positions, an average number of the recording-permitted pixels in an increment in each mask pattern of the first mask pattern groups is a predetermined value or less, both a recording-permitted pixel group configured including a plurality of the recording-permitted pixels adjacent to each other in the array direction or the scanning direction and a recording-permitted pixel not adjacent to other recording-permitted pixels being counted as an increment, and an average number of the recording-permitted pixels in the increments in a first logical sum pattern, obtained as a logical sum of the plurality of the recording-permitted pixels laid out in each of the mask patterns within the first mask pattern group, is greater than the predetermined value.

2. The image recording apparatus according to claim 1, wherein the predetermined value is smaller than 8.

3. The image recording apparatus according to claim 2, wherein the average number of the recording-permitted pixels in the increments in each of the mask patterns of the first mask pattern group is 1.

4. The image recording apparatus according to claim 1, wherein the average number of the recording-permitted pixels in the increments in the first logical sum pattern is 16 or greater.

5. The image recording apparatus according to claim 1, wherein the average number of the recording-permitted pixels adjacent to other recording-permitted pixels within each mask pattern of the first mask pattern group, in a diagonal direction which intersects the array direction and the scanning direction, is a value greater than the average number of the recording-permitted pixels in the increments of the mask patterns in the first mask pattern group and smaller than the average number of the recording-permitted pixels in the increment in the first logical sum pattern.

6. The image recording apparatus according to claim 1, wherein each of the plurality of first pixel regions includes a total of at least 16 of the recording-permitted pixels and the recording-not-permitted pixel;

and wherein each of the plurality of second pixel regions includes at least 16 of the recording-not-permitted pixels.

7. The image recording apparatus according to claim 1, wherein each of the mask patterns in the first mask pattern group is configured including only a plurality of the first pixel regions and a plurality of the second pixel regions.

8. The image recording apparatus according to claim 1, wherein the number of the recording-not-permitted pixels laid out between the plurality of increments in the first logical sum pattern is 4 or more.

9. The image recording apparatus according to claim 1, wherein, with regard to a second mask pattern group made up of at least two mask patterns, which differ from the mask patterns of the first mask pattern group, out of the plurality of mask patterns, each of the mask patterns in the second mask pattern group includes a plurality of the first pixel regions and a plurality of the second pixel regions, the plurality of first pixel regions in each of the mask patterns of the second mask pattern group are configured at mutually corresponding positions, an average number of the recording-permitted pixels in the increment in each mask pattern of the second mask pattern groups is a predetermined value or less, an average number of the recording-permitted pixels in the increments in a second logical sum pattern, obtained as a logical sum of the plurality of the recording-permitted pixels laid out in each of the mask patterns within the second mask pattern group, is greater than the predetermined value, and the recording-permitted pixels in the second logical sum pattern and the recording-permitted pixels in the first logical sum pattern are laid out at mutually exclusive positions.

10. The image recording apparatus according to claim 1, wherein the first mask pattern group includes a first and second of the mask patterns;

and wherein the generating unit uses the first mask pattern at a time of generating recording data to discharge ink as to the unit region in a first scan out of the plurality of scans, and uses the second mask pattern at a time of generating recording data to discharge ink as to the unit region in a second scan out of the plurality of scans performed a predetermined number of scans after the first scan, the predetermined number of scans being two scans or more.

11. The image recording apparatus according to claim 10, wherein the plurality of mask patterns is configured including a plurality of mask pattern groups, each mask pattern group including at least two of the mask patterns;

and wherein the predetermined number of scans is preferably a number of scans equivalent to N/M where N is the number of times of scanning by the scanning unit and M is the number of the plurality of mask pattern groups.

12. The image recording apparatus according to claim 11, wherein a third logical sum pattern, obtained from the plurality of recording permitting pixels in each of M mask patterns applied in the M scans from the first scan to the M'th scan of the unit region, does not include the second pixel region.

13. The image recording apparatus according to claim 1, wherein the recording head includes a first recording head having at least one discharge orifice row in which a plurality of discharge orifices configured to discharge ink of a first color are arrayed in the array direction, and a second recording head having at least one discharge orifice row in which a plurality of discharge orifices configured to discharge ink of a second color which differs from the first color are arrayed in the array direction;

wherein the recording-permitted pixels in each mask pattern in the first mask pattern group corresponding to the first record head, and the recording-permitted pixels in each mask pattern in the first mask pattern group corresponding to the second record head, are laid out at mutually exclusive positions;

and wherein the first pixel region in each mask pattern in the first mask pattern group corresponding to the first record head, and the first pixel region in each mask pattern in the first mask pattern group corresponding to the second record head, are configured at the same position as each other.

14. The image recording apparatus according to claim 1, wherein the recording head has a plurality of the discharge orifices rows arrayed in the array direction;

and wherein the mask patterns in the first mask pattern group correspond to discharge orifices groups within discharge orifices rows that are different from each other.

15. The image recording apparatus according to claim 1, wherein each mask pattern in the first mask pattern group has blue noise properties.

16. The image recording apparatus according to claim 1, wherein the plurality of mask patterns each have generally the same number of recording-permitted pixels laid out therein.

17. The image recording apparatus according to claim 1, wherein the recording-permitted pixels in the plurality of mask patterns are laid out a mutually exclusive and complementary positions.

18. The image recording apparatus according to claim 1, wherein the number of second pixel regions making up the first mask pattern group is greater than the number of first pixel regions making up the first mask pattern group.

19. The image recording apparatus according to claim 1, further comprising:

a heating unit configured to heat ink applied to the recording medium.

20. The image recording apparatus according to claim 19, wherein the ink of a predetermined color includes a resin emulsion.

21. The image recording apparatus according to claim 19, wherein the recording medium includes a substrate, and a layer of polyvinyl chloride formed upon the substrate.

22. An image recording apparatus which records images, comprising:

a recording head configured including at least one discharge orifice row in which a plurality of discharge orifices for discharging ink of a predetermined color are arrayed in an array direction;

a scanning unit configured to cause the recording head and a unit region on a recording medium to be scanned a plurality of times in a scanning direction which intersects the array direction;

a conveying unit configured to convey the recording medium a distance corresponding to a length in the array direction of each of a plurality of discharge orifice groups of a predetermined number of discharge orifices continuously arrayed in the array direction, configured as divisions of the plurality of discharge orifices in a conveying direction which intersects the scanning direction, the conveying being performed in between the plurality of scans of the recording head;

a generating unit configured to generate recording data so as to discharge ink to the unit region from the plurality of discharge orifice groups, in each of the plurality of scans of image data corresponding to the unit region performed as to the unit region, based on a plurality of mask patterns corresponding to each of the plurality of discharge orifice groups, in each of which mask patterns recording-permitted pixels determining permission of recording to the unit region and recording-not-permitted pixel determining non-permission of recording thereto have been laid out; and a recording control unit configured to discharge ink from each of the plurality of discharge orifice groups to the unit region in each of the plurality of scans, based on the recording data;

wherein, with regard to a first mask pattern group made up of at least two mask patterns out of the plurality of mask patterns, each mask pattern in the first mask pattern group includes a plurality of first pixel regions where a plurality of the recording-permitted pixels and a plurality of the recording-not-permitted pixels have been laid out, and a plurality of second pixel regions where only a plurality of recording-not-permitted pixels have been laid out, the plurality of first pixel regions in each of the mask patterns in the first mask pattern group are configured at mutually corresponding positions, dispersiveness of the recording-permitted pixels in a first logical sum pattern obtained from the logical sum of a plurality of the recording-permitted pixels laid out in each of the mask patterns of the first mask pattern group is lower than the dispersiveness of the recording-permitted pixels in each of the mask patterns of the first mask pattern group, and the recording-permitted pixels are laid out at almost all positions in a region equivalent to the first pixel region in the first logical sum pattern.

23. An image recording method to record images, comprising:

scanning a recording head, configured including at least one discharge orifice row in which a plurality of discharge orifices for discharging ink of a predetermined color are arrayed in an array direction, and a unit region on a recording medium, a plurality of times in a scanning direction which intersects the array direction;

conveying the recording medium a distance corresponding to a length in the array direction of each of a plurality of discharge orifice groups of a predetermined number of discharge orifices continuously arrayed in the array direction, configured as divisions of the plurality of discharge orifices in a conveying direction which intersects the scanning direction, the conveying being performed in between the plurality of scans of the recording head;

generating recording data so as to discharge ink to the unit region from the plurality of discharge orifice groups, in each of the plurality of scans of image data corresponding to the unit region performed as to the unit region, based on a plurality of mask patterns corresponding to each of the plurality of discharge orifice groups, in each of which mask patterns recording-permitted pixels determining permission of recording to the unit region and recording-not-permitted pixel determining non-permission of recording thereto have been laid out; and recording by discharging ink from each of the plurality of discharge orifice groups to the unit region in each of the plurality of scans, based on the recording data;

wherein, with regard to a first mask pattern group made up of at least two mask patterns out of the plurality of mask patterns, each mask pattern in the first mask pattern group includes a plurality of first pixel regions where a plurality of the recording-permitted pixels and a plurality of the recording-not-permitted pixels have been laid out, and a plurality of second pixel regions where only a plurality of recording-not-permitted pixels have been laid out, the plurality of first pixel regions in each of the mask patterns in the first mask pattern group are configured at mutually corresponding positions, an average number of the recording-permitted pixels in an increment in each mask pattern of the first mask pattern groups is a predetermined value or less, both a recording-permitted pixel group configured including a plurality of the recording-permitted pixels adjacent to each other in the array direction or the scanning direction and a recording-permitted pixel not adjacent to other recording-permitted pixels being counted as an increment, and an average number of the recording-permitted pixels in the increments in a first logical sum pattern, obtained as a logical sum of the plurality of the recording-permitted pixels laid out in each of the mask patterns within the first mask pattern group, is greater than the predetermined value.

24. A recording medium, storing a program causing a computer of an image recording apparatus to execute the image recording method according to claim 23.

* * * * *